US009517544B2

(12) United States Patent
Takahashi et al.

(10) Patent No.: US 9,517,544 B2
(45) Date of Patent: Dec. 13, 2016

(54) POLISHING APPARATUS AND POLISHING METHOD

(71) Applicant: EBARA CORPORATION, Tokyo (JP)

(72) Inventors: Tamami Takahashi, Tokyo (JP); Masaya Seki, Tokyo (JP); Hiroaki Kusa, Tokyo (JP); Kenji Yamaguchi, Tokyo (JP); Masayuki Nakanishi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 14/577,101

(22) Filed: Dec. 19, 2014

(65) Prior Publication Data

US 2015/0104620 A1 Apr. 16, 2015

Related U.S. Application Data

(62) Division of application No. 13/459,421, filed on Apr. 30, 2012, now Pat. No. 8,986,069, which is a division
(Continued)

(30) Foreign Application Priority Data

Dec. 3, 2007 (JP) ..... 2007-312724
Nov. 14, 2008 (JP) ..... 2008-292193

(51) Int. Cl.
*B24B 21/00* (2006.01)
*B24B 9/06* (2006.01)
(Continued)

(52) U.S. Cl.
CPC ..... *B24B 21/002* (2013.01); *B24B 9/065* (2013.01); *B24B 21/004* (2013.01);
(Continued)

(58) Field of Classification Search
None
See application file for complete search history.

(56) References Cited

U.S. PATENT DOCUMENTS 5,509,850 A 4/1996 Morioka et al.
5,713,784 A 2/1998 Miller
(Continued)

FOREIGN PATENT DOCUMENTS

CN 2853279 Y 1/2007
CN 1914711 A 2/2007
(Continued)

OTHER PUBLICATIONS

Extended European Search Report issued Feb. 11, 2016 in corresponding European Patent Application No. 15187259.5.
(Continued)

*Primary Examiner* — Dung Van Nguyen
(74) *Attorney, Agent, or Firm* — Wenderoth, Lind & Ponack, L.L.P.

(57) ABSTRACT

A polishing apparatus polishes a periphery of a substrate. This polishing apparatus includes a rotary holding mechanism configured to hold the substrate horizontally and rotate the substrate, plural polishing head assemblies provided around the substrate, plural tape supplying and recovering mechanisms configured to supply polishing tapes to the plural polishing head assemblies and recover the polishing tapes from the plural polishing head assemblies, and plural moving mechanisms configured to move the plural polishing head assemblies in radial directions of the substrate held by the rotary holding mechanism. The tape supplying and recovering mechanisms are located outwardly of the plural polishing head assemblies in the radial directions of the substrate, and the tape supplying and recovering mechanisms are fixed in position.

10 Claims, 38 Drawing Sheets

Related U.S. Application Data of application No. 12/292,662, filed on Nov. 24, 2008, now Pat. No. 8,187,055.

(51) Int. Cl.

| | |
|---|---|
| ***B24B 37/04*** | (2012.01) |
| ***B24B 37/30*** | (2012.01) |
| ***B24B 21/20*** | (2006.01) |
| ***B24B 27/00*** | (2006.01) |
| ***B24B 41/06*** | (2012.01) |
| ***B24B 49/00*** | (2012.01) |

(52) U.S. Cl.

CPC ..... *B24B 21/008* (2013.01); *B24B 21/20* (2013.01); *B24B 27/0076* (2013.01); *B24B 37/042* (2013.01); *B24B 37/30* (2013.01); *B24B 41/068* (2013.01); *B24B 49/00* (2013.01); *Y10T 428/24777* (2015.01)

(56) References Cited

U.S. PATENT DOCUMENTS

| | | | | |
|---|---|---|---|---|
| 5,928,060 | A | 7/1999 | Miller | |
| 6,193,590 | B1 | 2/2001 | Weiss et al. | |
| 6,402,596 | B1 | 6/2002 | Hakomori et al. | |
| 6,629,875 | B2 | 10/2003 | Steere, III | |
| 6,641,464 | B1 * | 11/2003 | Steere, III | B24B 21/002 451/287 |
| 7,014,529 | B1 * | 3/2006 | Kubota | B24B 37/015 451/168 |
| 7,108,582 | B2 | 9/2006 | Sato et al. | |
| 7,682,225 | B2 | 3/2010 | Hongo et al. | |
| 8,029,333 | B2 | 10/2011 | Takahashi et al. | |
| 9,287,158 | B2 * | 3/2016 | Takahashi | H01L 21/68707 |
| 2001/0011002 | A1 | 8/2001 | Steere, III | |
| 2004/0185751 | A1 | 9/2004 | Nakanishi et al. | |
| 2006/0094343 | A1 | 5/2006 | Sato et al. | |
| 2007/0131653 | A1 | 6/2007 | Ettinger et al. | |
| 2007/0131654 | A1 | 6/2007 | Wasinger et al. | |
| 2008/0200100 | A1 * | 8/2008 | Takahashi | B24B 9/065 451/44 |
| 2008/0293344 | A1 | 11/2008 | Ettinger et al. | |
| 2009/0017730 | A1 | 1/2009 | Kubota et al. | |
| 2009/0017733 | A1 * | 1/2009 | Takahashi | B24B 9/065 451/57 |
| 2009/0036033 | A1 | 2/2009 | Wasinger et al. | |
| 2009/0117828 | A1 | 5/2009 | Hongo et al. | |
| 2010/0105299 | A1 | 4/2010 | Ettinger et al. | |

FOREIGN PATENT DOCUMENTS

| | | |
|---|---|---|
| CN | 101006562 | 7/2007 |
| EP | 1 120 191 | 8/2001 |
| EP | 1 738 870 | 1/2007 |
| EP | 1 860 689 | 11/2007 |
| JP | 01316160 | 12/1989 |
| JP | 2005-252288 | 9/2005 |
| JP | 2006-303112 | 11/2006 |
| JP | 2007-524231 | 8/2007 |
| JP | 2007-294920 | 11/2007 |
| TW | 483801 | 4/2002 |
| TW | 200531166 | 9/2005 |
| TW | 200644140 | 12/2006 |
| WO | 2005/081301 | 9/2005 |
| WO | 2006/041196 | 4/2006 |
| WO | 2006/112530 | 10/2006 |
| WO | 2006/112531 | 10/2006 |
| WO | 2006/112532 | 10/2006 |

OTHER PUBLICATIONS

Partial European Search Report issued Aug. 2, 2012 in corresponding European Patent Application No. 08020811.9.

Partial European Search Report issued Jan. 3, 2013 in corresponding European Patent Application No. 080208119.9.

Extended European Search Report issued Mar. 5, 2014 in corresponding European Patent Application 13005371.3.

* cited by examiner

POLISHING APPARATUS AND POLISHING METHOD

This application is a Divisional of U.S. application Ser. No. 13/459,421, filed Apr. 30, 2012, which is a Divisional of U.S. application Ser. No. 12/292,662, filed Nov. 24, 2008, now U.S. Pat No. 8,187,055.

BACKGROUND OF THE INVENTION

1. Field of the Invention

The present invention relates to a polishing apparatus and a polishing method for polishing a substrate such as a semiconductor wafer, and more particularly to a polishing apparatus suitable for use as a bevel polishing apparatus for polishing a bevel portion of a substrate and as a notch polishing apparatus for polishing a notch portion of a substrate.

2. Description of the Related Art

From a viewpoint of improving a yield in semiconductor fabrications, management of a surface condition in a periphery of a semiconductor wafer has recently been drawing attention. In semiconductor fabrication processes, a number of materials are deposited on a wafer repeatedly to form multilayer structures. As a result, unwanted films and a roughened surface are formed on a periphery of the wafer which is not used for products. In recent years, it has become more common to transfer the wafer by holding only the periphery of the wafer with arms. Under such circumstances, the unwanted films could come off the periphery onto devices formed on the wafer during several processes, resulting in a lowered yield. Thus, it is conventional to polish the periphery of the wafer using a polishing apparatus so as to remove the unwanted films and the roughened surface.

A polishing apparatus using a polishing tape for polishing a periphery of a substrate has been known as such a type of polishing apparatus. This type of polishing apparatus polishes the periphery of the substrate by bringing a polishing surface of the polishing tape into sliding contact with the periphery of the substrate. Since a type and a thickness of an unwanted film to be removed vary from substrate to substrate, multiple polishing tapes with different roughness are generally used. Typically, rough polishing is performed so as to remove the unwanted film and form a shape of the periphery, and then finish polishing is performed so as to form a smooth surface.

A bevel portion and a notch portion are generally formed in the periphery of the substrate. The bevel portion is a part of the periphery where angular edges have been removed. This bevel portion is formed for the purpose of preventing the substrate from being cracked and preventing production of particles. On the other hand, the notch portion is a cutout portion formed in the periphery of the substrate for the purpose of specifying a crystal orientation. The above-described polishing apparatus for polishing the periphery of the substrate can be classified roughly into a bevel polishing apparatus for polishing the bevel portion and a notch polishing apparatus for polishing the notch portion.

Examples of the conventional bevel polishing apparatus include a polishing apparatus having a single polishing head and a polishing apparatus having multiple polishing heads. In the polishing apparatus having a single polishing head, multistage polishing is performed by replacing a polishing tape with another polishing tape having a different roughness after polishing or by transferring the substrate from a rough-polishing section to a finish-polishing section. On the other hand, in the polishing apparatus having multiple polishing heads, rough polishing and finish polishing can be performed successively.

However, in these conventional apparatuses, a long polishing time is required as a whole, because finish polishing is performed after rough polishing. Specifically, the total polishing time is the sum of a rough-polishing time and a finish-polishing time. In addition, the polishing tape needs to be replaced with a new polishing tape periodically, because the polishing tape is a consumable part. Therefore, there is a demand for easy operation for replacing the polishing tape as a consumable part, and there is also a demand for use of as long a polishing tape as possible in view of reducing frequency of the tape-replacement operations.

On the other hand, as disclosed in Japanese laid-open patent publication No. 2005-252288, a polishing apparatus configured to press plural polishing tapes with different roughness against the periphery of the substrate successively is known as a conventional notch polishing apparatus. However, in this conventional apparatus, polishing heads are close to each other and this arrangement makes it difficult to conduct maintenance of the polishing heads. In addition, since reels each containing the polishing tape are adjacent to each other, it is difficult to replace the polishing tape. As a result, a polishing time including the replacement time of the polishing tapes becomes long.

SUMMARY OF THE INVENTION

The present invention has been made in view of the above drawbacks. It is therefore an object of the present invention to provide a polishing apparatus which can shorten the total polishing time and can make it easy to replace the polishing tape. Further, another object of the present invention is to provide a polishing method using such a polishing apparatus.

One aspect of the present invention for achieving the above object is to provide a polishing apparatus for polishing a periphery of a substrate. The apparatus includes a rotary holding mechanism configured to hold the substrate horizontally and rotate the substrate, plural polishing head assemblies provided around the substrate held by the rotary holding mechanism, plural tape supplying and recovering mechanisms configured to supply polishing tapes to the plural polishing head assemblies and recover the polishing tapes from the plural polishing head assemblies, and plural moving mechanisms configured to move the plural polishing head assemblies in radial directions of the substrate held by the rotary holding mechanism. Each of the plural polishing head assemblies includes a polishing head configured to press the polishing tape against the periphery of the substrate, and a tilt mechanism configured to rotate the polishing head about an axis parallel to a tangent line of the substrate. The polishing head includes a tape-sending mechanism configured to hold the polishing tape and send the polishing tape in its longitudinal direction at a predetermined speed, and guide rollers arranged so as to guide a travel direction of the polishing tape to a direction perpendicular to the tangent line of the substrate. The tape supplying and recovering mechanisms are located outwardly of the plural polishing head assemblies in the radial directions of the substrate, and the tape supplying and recovering mechanisms are fixed in position.

In a preferred aspect of the present invention, the plural moving mechanisms are operable independently of each other, and the tilt mechanisms of the polishing head assemblies are operable independently of each other.

In a preferred aspect of the present invention, the polishing apparatus further includes an upper supply nozzle configured to supply a polishing liquid onto an upper surface of the substrate held by the rotary holding mechanism, a lower supply nozzle configured to supply a polishing liquid onto a lower surface of the substrate held by the rotary holding mechanism, and at least one cleaning nozzle configured to supply a cleaning liquid to the polishing heads.

In a preferred aspect of the present invention, the rotary holding mechanism includes a holding stage configured to hold the substrate and an elevating mechanism configured to vertically move the holding stage.

In a preferred aspect of the present invention, the plural polishing head assemblies and the plural tape supplying and recovering mechanisms are located below a horizontal plane lying at a predetermined height, and the elevating mechanism is operable to vertically move the holding stage between a transfer position above the horizontal plane and a polishing position below the horizontal plane.

In a preferred aspect of the present invention, the polishing apparatus further includes a partition wall shaped so as to form a polishing chamber therein. The plural polishing head assemblies and the holding stage are located in the polishing chamber and the plural tape supplying and recovering mechanisms are located outside the polishing chamber.

In a preferred aspect of the present invention, a travel direction of the polishing tape in at least one of the plural polishing head assemblies is opposite to a travel direction of the polishing tape in another of the plural polishing head assemblies.

In a preferred aspect of the present invention, the polishing apparatus further includes at least one fixed-angle polishing head assembly having a polishing head whose angle of inclination is fixed.

In a preferred aspect of the present invention, the polishing apparatus further includes plural centering guides configured to align a center of the substrate with a rotational axis of the rotary holding mechanism.

In a preferred aspect of the present invention, the plural centering guides are movable together with the plural polishing head assemblies.

In a preferred aspect of the present invention, the polishing apparatus further includes an eccentricity detector configured to detect at least one of an eccentricity, a notch portion, and an orientation flat of the substrate held by the rotary holding mechanism.

In a preferred aspect of the present invention, the polishing apparatus further includes a supply nozzle configured to supply a liquid onto the substrate held by the rotary holding mechanism, and an operation controller for controlling operations of the plural polishing head assemblies. The operation controller is operable to keep at least one of the polishing heads, that does not perform polishing, away from the substrate during supply of the liquid onto the rotating substrate such that the liquid does not bounce back to the substrate.

In a preferred aspect of the present invention, the operation controller is operable to determine a distance between the substrate and the at least one of the polishing heads based on a rotational speed of the substrate.

In a preferred aspect of the present invention, the operation controller is operable to keep at least one of the polishing heads, that does not perform polishing, inclined during supply of the liquid onto the rotating substrate at such an angle that the liquid does not bounce back to the substrate.

In a preferred aspect of the present invention, the operation controller is operable to determine the angle of the at least one of the polishing heads based on a rotational speed of the substrate.

In a preferred aspect of the present invention, the operation controller is operable to move the at least one of the polishing heads toward the substrate while keeping the angle thereof, and to cause the at least one of the polishing heads to press a polishing tape against the periphery of the substrate.

Another aspect of the present invention is to provide a polishing apparatus for polishing a periphery of a substrate. The apparatus includes a rotary holding mechanism configured to hold the substrate horizontally and to rotate the substrate, at least one polishing head assembly provided so as to face the periphery of the substrate held by the rotary holding mechanism, at least one tape supplying and recovering mechanism configured to supply a polishing tape to the at least one polishing head assembly and recover the polishing tape from the at least one polishing head assembly, at least one moving mechanism configured to move the at least one polishing head assembly in a radial direction of the substrate held by the rotary holding mechanism, and a supply nozzle configured to supply a cooling liquid to a contact portion between the polishing tape and the substrate held by the rotary holding mechanism.

In a preferred aspect of the present invention, the at least one polishing head assembly comprises plural polishing head assemblies, the at least one tape supplying and recovering mechanism comprises plural tape supplying and recovering mechanisms, and the least one moving mechanism comprises plural moving mechanisms.

In a preferred aspect of the present invention, the polishing apparatus further includes a cooling liquid supply source configured to supply the cooling liquid to the supply nozzle.

In a preferred aspect of the present invention, the cooling liquid supply source is configured to produce the cooling liquid having a temperature of at most 10° C.

Another aspect of the present invention is to provide a polishing method including rotating a substrate by a rotary holding mechanism, polishing a first region in a periphery of the substrate by pressing a polishing tape against the first region, polishing a second region in the periphery of the substrate by pressing the polishing tape against the second region, during the polishing of the second region, cleaning the first region by pressing a cleaning cloth against the first region, and after the polishing of the second region, cleaning the second region by pressing the cleaning cloth against the second region.

Another aspect of the present invention is to provide a polishing method including rotating a substrate by a rotary holding mechanism, polishing a periphery of the substrate by pressing a polishing tape against the periphery of the substrate, and during the polishing, supplying a cooling liquid having a temperature of at most 10° C. to a contact portion between the substrate and the polishing tape.

Another aspect of the present invention is to provide a polishing method including rotating a substrate by a rotary holding mechanism, supplying a liquid onto the rotating substrate, during the supplying of the liquid onto the rotating substrate, pressing a polishing tape by a first polishing head against a periphery of the substrate so as to polish the periphery, and during the supplying of the liquid onto the rotating substrate, keeping a second polishing head, that does not perform polishing, away from the substrate such that the liquid does not bounce back to the substrate.

Another aspect of the present invention is to provide a polishing method including rotating a substrate by a rotary holding mechanism, supplying a liquid onto the rotating substrate, during the supplying of the liquid onto the rotating substrate, pressing a polishing tape by a first polishing head against a periphery of the substrate so as to polish the periphery, and during the supplying of the liquid onto the rotating substrate, keeping a second polishing head, that does not perform polishing, inclined at such an angle that the liquid does not bounce back to the substrate.

Another aspect of the present invention is to provide a substrate characterized by being polished by the above-described polishing method.

Another aspect of the present invention is to provide a polishing apparatus for polishing a notch portion of a substrate. The polishing apparatus includes a rotary holding mechanism configured to hold the substrate horizontally and rotate the substrate, plural polishing head modules each configured to polish the substrate using a polishing tape, and a moving mechanism configured to move the plural polishing head modules independently of each other. Each of the plural polishing head modules includes a polishing head configured to bring the polishing tape into sliding contact with the notch portion of the substrate, and a tape supplying and recovering mechanism configured to supply the polishing tape to the polishing head and recover the polishing tape from the polishing head.

In a preferred aspect of the present invention, the moving mechanism includes a single X-axis moving mechanism and plural Y-axis moving mechanisms configured to move the plural polishing head modules along a X axis and a Y axis which are perpendicular to each other, the X-axis moving mechanism is configured to move the plural polishing head modules synchronously along the X axis, and the plural Y-axis moving mechanisms are configured to move the plural polishing head modules independently of each other along the Y axis.

In a preferred aspect of the present invention, the moving mechanism is configured to move the polishing head of each of the plural polishing head modules along a single movement axis toward and away from the notch portion of the substrate.

In a preferred aspect of the present invention, the rotary holding mechanism includes a swinging mechanism configured to cause the substrate to perform swinging motion, centered on the notch portion, in a plane parallel to a surface of the substrate.

In a preferred aspect of the present invention, the rotary holding mechanism includes a holding stage configured to hold the substrate and an elevating mechanism configured to vertically moving the holding stage.

In a preferred aspect of the present invention, the polishing apparatus further includes a notch searching unit configured to detect the notch portion of the substrate. The elevating mechanism is operable to lower the holding stage from a transfer position of the substrate to a polishing position of the substrate and to elevate the holding stage from the polishing position to the transfer position, and the notch searching unit is provided at the same height as the transfer position.

In a preferred aspect of the present invention, at least one of the plural polishing head modules includes a tension sensor configured to measure a tension of the polishing tape, and the polishing apparatus further includes a monitoring unit configured to monitor the tension of the polishing tape based on an output signal of the tension sensor.

Another aspect of the present invention is to provide a polishing apparatus for polishing a notch portion of a substrate. The polishing apparatus includes a rotary holding mechanism configured to hold the substrate horizontally and rotate the substrate, a polishing head module configured to polish the substrate using a polishing tape, and a monitoring unit configured to monitor a tension of the polishing tape. The polishing head module includes a polishing head configured to bring the polishing tape into sliding contact with the notch portion of the substrate, and a tape supplying and recovering mechanism configured to supply the polishing tape to the polishing head and recover the polishing tape from the polishing head, and a tension sensor configured to measure a tension of the polishing tape. The monitoring unit is configured to monitor the tension of the polishing tape based on an output signal of the tension sensor.

According to the present invention, the plural polishing heads holding the polishing tapes with different roughness can be used to polish a substrate. The polishing head, that has terminated its polishing operation, is tilted to another polishing angle via a tilting motion, and another polishing head can further polish the same portion that has been polished. Therefore, without waiting the termination of the polishing operation by one of the polishing head assemblies, another polishing head assembly can polish the same portion that has been polished. Further, since the polishing tapes can be easily replaced, the polishing time as a whole can be shortened.

DETAILED DESCRIPTION OF THE PREFERRED EMBODIMENTS

Embodiments of the present invention will be described below with reference to the drawings.

Figure 1:
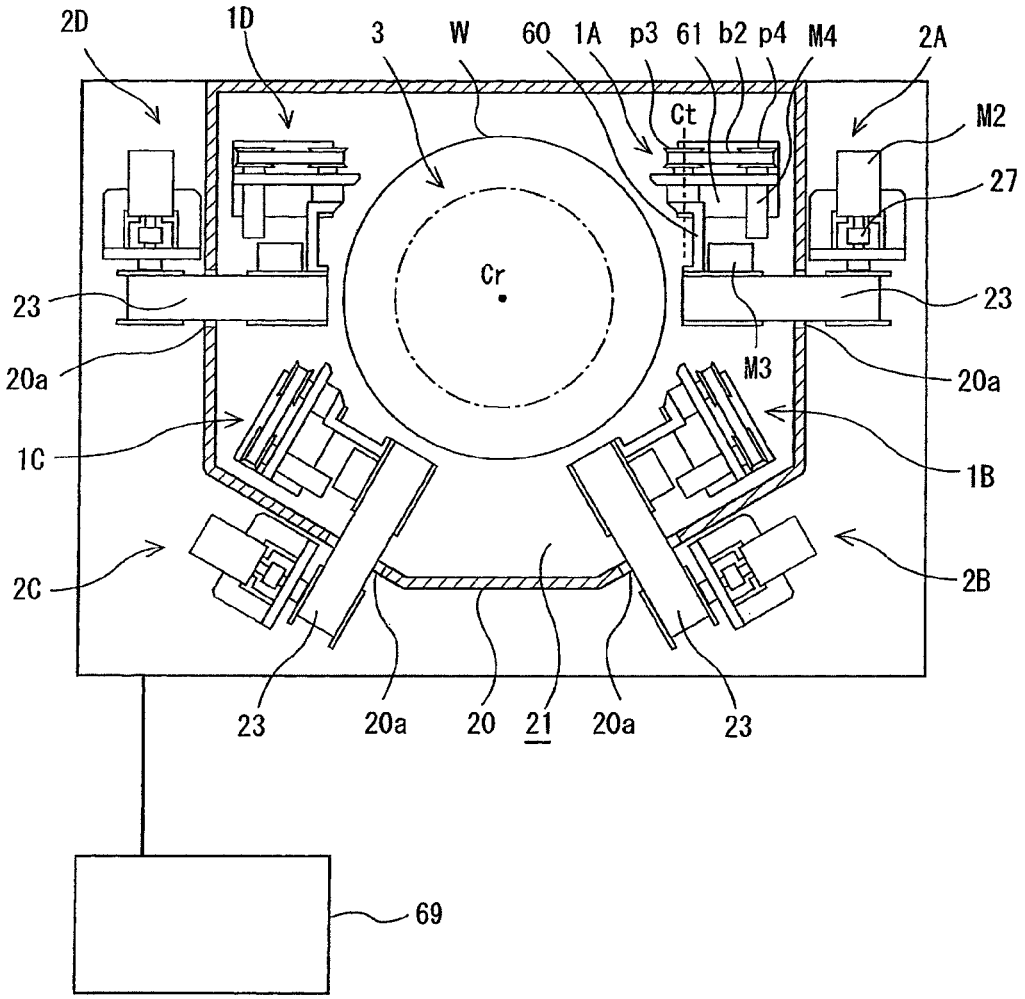
FIG. 1 is a plan view showing a polishing apparatus according to a first embodiment of the present invention.
Figure 2:
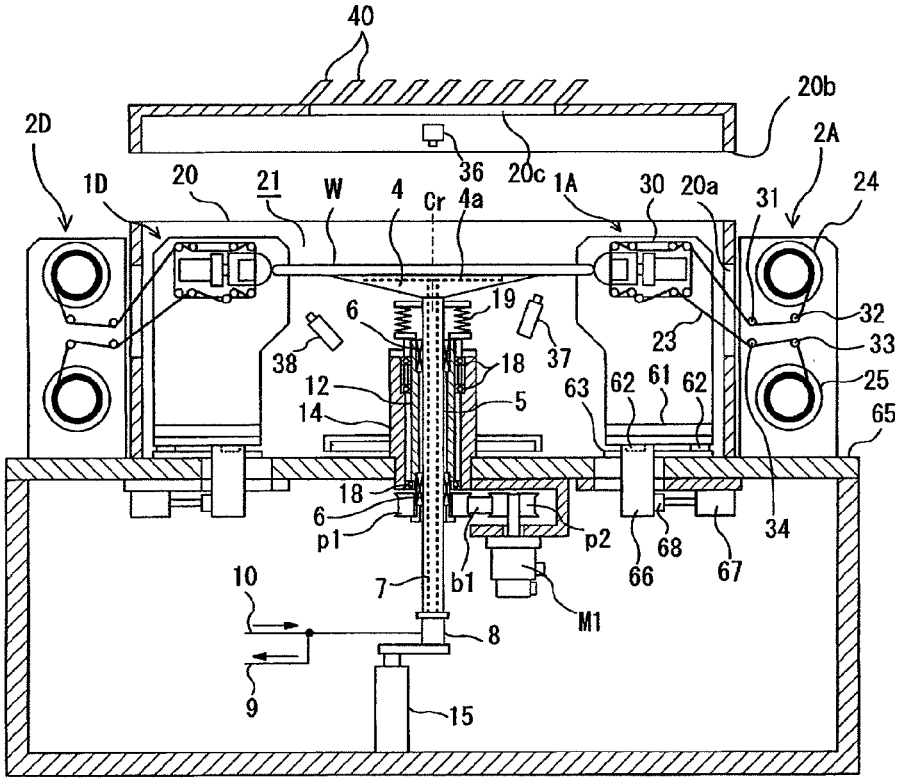
FIG. 2 is a vertical cross-sectional view of the polishing apparatus shown in FIG. 1.

FIG. 1 is a plan view showing a polishing apparatus according to a first embodiment of the present invention, and FIG. 2 is a vertical cross-sectional view of the polishing apparatus shown in FIG. 1. This polishing apparatus according to the first embodiment is suitable for use as a bevel polishing apparatus for polishing a bevel portion of a substrate. An example of the substrate to be polished is a semiconductor wafer, having a diameter of 300 mm, with films formed on a surface thereof.

As shown in FIG. 1 and FIG. 2, this polishing apparatus includes a rotary holding mechanism 3 configured to hold a wafer W (i.e., an object to be polished) horizontally and to rotate the wafer W. The rotary holding mechanism 3 is located in the center of the polishing apparatus. FIG. 1 shows a state in which the rotary holding mechanism 3 holds the wafer W. This rotary holding mechanism 3 has a dish-shaped holding stage 4 configured to hold a rear surface of the wafer W by a vacuum attraction, a hollow shaft 5 coupled to a central portion of the holding stage 4, and a motor M1 for rotating the hollow shaft 5. The wafer W is placed onto the holding stage 4 by hands of a transfer mechanism (which will be described later) such that a center of the wafer W is aligned with a rotational axis of the hollow shaft 5.

The hollow shaft 5 is supported by ball spline bearings (linear motion bearings) 6 which allow the hollow shaft 5 to move vertically. The holding stage 4 has an upper surface having grooves 4*a*. These grooves 4*a* are connected to a communication line 7 extending through the hollow shaft 5. This communication line 7 is coupled to a vacuum line 9 via a rotary joint 8 which is provided on a lower end of the hollow shaft 5. The communication line 7 is also coupled to a nitrogen-gas supply line 10 which is used for releasing the processed wafer W from the holding stage 4. By selectively coupling the vacuum line 9 or the nitrogen-gas supply line 10 to the communication line 7, the wafer W is attracted to the upper surface of the holding stage 4 by a vacuum suction or released from the upper surface of the holding stage 4.

The hollow shaft 5 is rotated by the motor M1 via a pulley p1 coupled to the hollow shaft 5, a pulley p2 attached to a rotational shaft of the motor M1, and a belt b1 riding on these pulleys p1 and p2. The rotational shaft of the motor M1 extends parallel to the hollow shaft 5. With these structures, the wafer W, held on the upper surface of the holding stage 4, is rotated by the motor M1.

The ball spline bearing 6 is a bearing that allows the hollow shaft 5 to move freely in its longitudinal direction. The ball spline bearings 6 are mounted on a casing 12. Therefore, in this embodiment, the hollow shaft 5 is allowed to move linearly up and down relative to the casing 12, and the hollow shaft 5 and the casing 12 are to rotate integrally.

The hollow shaft 5 is coupled to an air cylinder (elevating mechanism) 15, so that the hollow shaft 5 and the holding stage 4 are elevated and lowered by the air cylinder 15.

A casing 14 is provided so as to surround the casing 12. The casing 12 and the casing 14 are in a concentric arrangement. Radial bearings 18 are provided between the casing 12 and the casing 14, so that the casing 12 is rotatably supported by the radial bearings 18. With these structures, the rotary holding mechanism 3 can rotate the wafer W about a central axis Cr and can elevate and lower the wafer W along the central axis Cr.

As shown in FIG. 1, four polishing head assemblies 1A, 1B, 1C, and 1D are arranged around the wafer W held by the rotary holding mechanism 3. Tape supplying and recovering mechanisms 2A, 2B, 2C, and 2D are provided radially outwardly of the polishing head assemblies 1A, 1B, 1C, and 1D, respectively. The polishing head assemblies 1A, 1B, 1C, and 1D are isolated from the tape supplying and recovering mechanisms 2A, 2B, 2C, and 2D by a partition wall 20. An interior space of the partition wall 20 provides a polishing room 21. The four polishing head assemblies 1A, 1B, 1C, and 1D and the holding stage 4 are located in the polishing room 21. On the other hand, the tape supplying and recovering mechanisms 2A, 2B, 2C, and 2D are located outside the partition wall 20 (i.e., outside the polishing room 21). The respective polishing head assemblies 1A, 1B, 1C, and 1D have the same structure as each other, and the respective tape supplying and recovering mechanisms 2A, 2B, 2C, and 2D have the same structure as each other. Thus, the polishing head assembly 1A and the tape supplying and recovering mechanism 2A will be described in detail below.

The tape supplying and recovering mechanism 2A includes a supply reel 24 for supplying a polishing tape 23 (i.e., a polishing tool) to the polishing head assembly 1A, and a recovery reel 25 for recovering the polishing tape 23 that has been used in polishing of the wafer W. The supply reel 24 is arranged above the recovery reel 25. Motors M2 are coupled respectively to the supply reel 24 and the recovery reel 25 via couplings 27 (FIG. 1 shows only the coupling 27 and the motor M2 coupled to the supply reel 24). Each of the motors M2 is configured to exert a constant torque on a predetermined rotational direction so as to apply a predetermined tension to the polishing tape 23.

The polishing tape 23 is a long tape-shaped polishing tool, and one of surfaces thereof constitutes a polishing surface. The polishing tape 23 is wound on the supply reel 24, which is mounted on the tape supplying and recovering mechanism 2A. Both sides of the wound polishing tape 23 are supported by reel plates so as not to collapse. One end of the polishing tape 23 is attached to the recovery reel 25, so that the recovery reel 25 winds the polishing tape 23 supplied to the polishing head assembly 1A to thereby recover the polishing tape 23. The polishing head assembly 1A includes a polishing head 30 for pressing the polishing tape 23, supplied from the tape supplying and recovering mechanism 2A, against a periphery of the wafer W. The polishing tape 23 is supplied to the polishing head 30 such that the polishing surface of the polishing tape 23 faces the wafer W.

The tape supplying and recovering mechanism 2A has plural guide rollers 31, 32, 33, and 34. The polishing tape 23, to be supplied to and recovered from the polishing head assembly 1A, is guided by these guide rollers 31, 32, 33, and 34. The polishing tape 23 is supplied from the supply reel 24 to the polishing head 30 through an opening 20*a* formed in the partition wall 20, and the used polishing tape 23 is recovered by the recovery reel 25 through the opening 20*a*.

As shown in FIG. 2, an upper supply nozzle 36 is provided above the wafer W. This upper supply nozzle 36 is to supply a polishing liquid onto a center of an upper surface of the wafer W held by the rotary holding mechanism 3. Lower supply nozzles 37 are provided for supplying a polishing liquid onto a boundary between the rear surface (i.e., a lower surface) of the wafer W and the holding stage 4 of the rotary holding mechanism 3 (i.e., onto a periphery of the holding stage 4). Typically, pure water is used as the polishing liquid. Alternatively, ammonia may be used in a case where silica is used as abrasive grains of the polishing tape 23.

The polishing apparatus further includes cleaning nozzles 38 each for cleaning the polishing head 30 after the polishing process. Each of the cleaning nozzles 38 is operable to eject cleaning water to the polishing head 30 so as to clean the polishing head 30 used in the polishing process.

The polishing head assembly 1A is contaminated by polishing debris, such as copper, removed from the wafer W during polishing. On the other hand, since the tape supplying and recovering mechanism 2A is located outside the partition wall 20, the polishing liquid is not attached to the tape supplying and recovering mechanism 2A. Therefore, replacement of the polishing tape 23 can be conducted outside the polishing room 21 without contacting the polishing liquid and without a need to insert hands into the polishing room 21.

In order to keep the ball spline bearings 6 and the radial bearings 18 in isolation from the polishing room 21 when the hollow shaft 5 is elevated relative to the casing 12, the hollow shaft 5 and an upper end of the casing 12 are coupled to each other by a bellows 19 that is extendible and contractible in vertical directions, as shown in FIG. 2. FIG. 2 shows a state in which the hollow shaft 5 is in a lowered position and the holding stage 4 is in a polishing position. After the polishing process, the air cylinder 15 is operated so as to elevate the wafer W together with the holding stage 4 and the hollow shaft 5 to a transfer position, where the wafer W is released from the holding stage 4.

Figure 3:
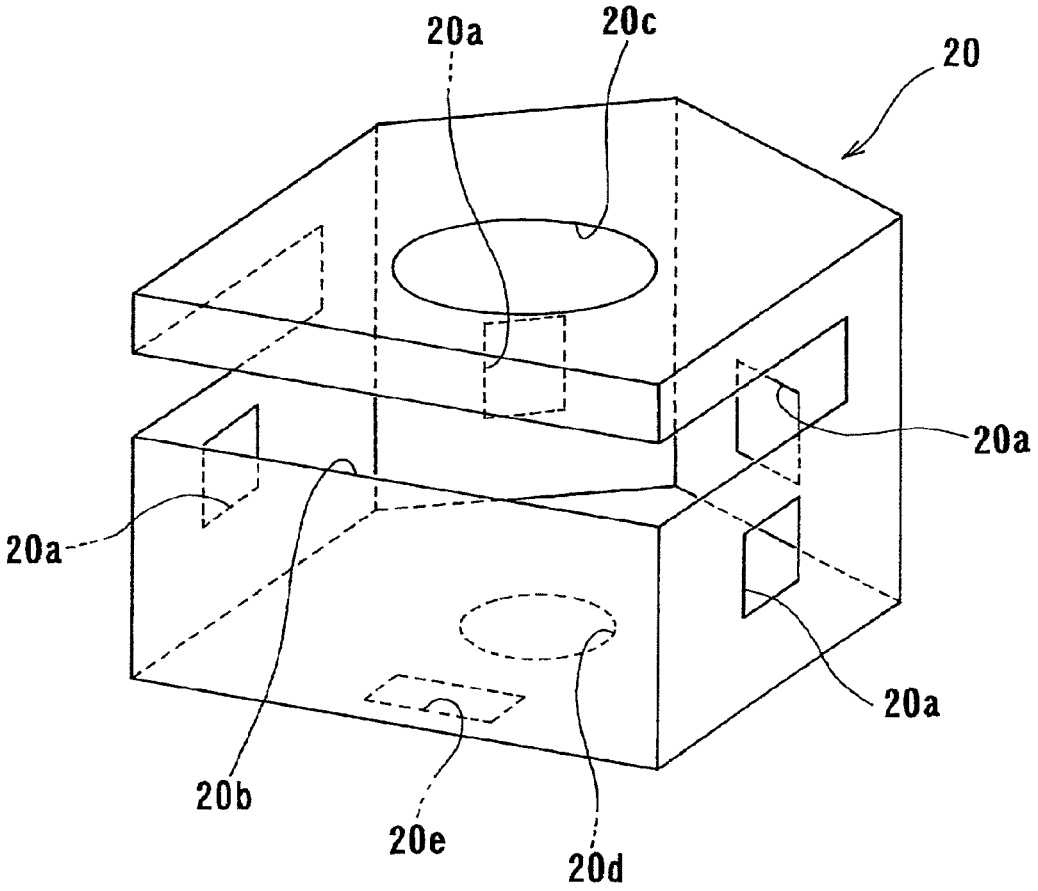
FIG. 3 is a perspective view showing a partition wall.

FIG. 3 is a perspective view showing the partition wall 20. This partition wall 20 is a box-shaped casing in which the polishing head assemblies 1A, 1B, 1C, and 1D and the holding stage 4 are housed. The partition wall 20 has plural openings 20*a* through which the respective polishing tapes 23 pass, and a transfer opening 20*b* through which the wafer W is transferred into and removed from the polishing room 21. The transfer opening 20*b* is formed in three fronts of the partition wall 20, and has a shape of horizontally extending notch. Therefore, the wafer W, held by the transfer mechanism, can be moved horizontally across the polishing room 21 through the transfer opening 20*b*. A non-illustrate shutter is provided so as to cover the transfer opening 20*b*. This shutter is usually closed, and opened only when the wafer W is transferred. An upper surface of the partition wall 20 has an opening 20*c* covered by louvers 40 (see FIG. 2), and a lower surface of the partition wall 20 has an opening 20*d* through which the rotary holding mechanism 3 passes, and further has a gas-discharge opening 20*e*.

Figure 4A:
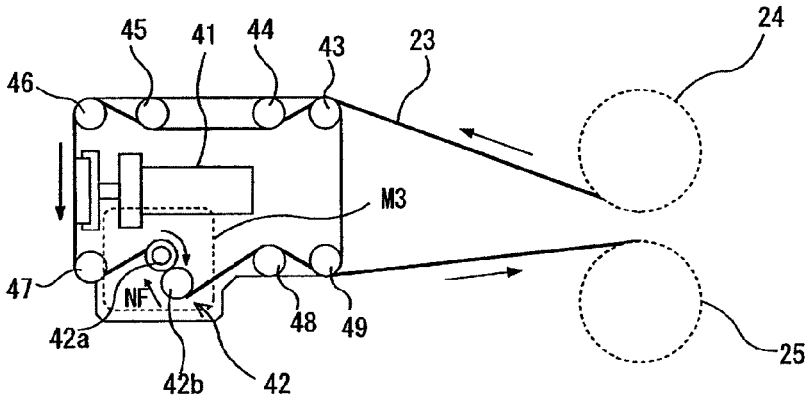
FIG. 4A is an enlarged view showing a polishing head.

FIG. 4A is an enlarged view of the polishing head 30. As shown in FIG. 4A, the polishing head 30 has a pressing mechanism 41 configured to apply pressure to a rear surface of the polishing tape 23 so as to press the polishing tape 23 against the wafer W at a predetermined force. The polishing head 30 further includes a tape-sending mechanism 42 configured to send the polishing tape 23 from the supply reel 24 to the recovery reel 25. The polishing head 30 has plural guide rollers 43, 44, 45, 46, 47, 48, and 49, which guide the polishing tape 23 such that the polishing tape 23 travels in a direction perpendicular to a tangential direction of the wafer W.

The tape-sending mechanism 42 of the polishing head 30 includes a tape-sending roller 42*a*, a tape-holding roller 42*b*, and a motor M3 configured to rotate the tape-sending roller 42*a*. The motor M3 is disposed on a side surface of the polishing head 30. The tape-sending roller 42*a* is coupled to a rotational shaft of the motor M3. The polishing tape 23 is wound about half around the tape-sending roller 42*a*. The tape-holding roller 42*b* is located adjacent to the tape-sending roller 42*a*. The tape-holding roller 42*b* is supported by a non-illustrate mechanism, which exerts a force on the tape-holding roller 42*b* in a direction indicated by NF in FIG. 4A (i.e., in a direction toward the tape-sending roller 42*a*) so as to press the tape-holding roller 42*b* against the tape-sending roller 42*a*.

The polishing tape 23 is wound on the tape-sending roller 42*a*, passes between the tape-sending roller 42*a* and the tape-holding roller 42*b*, and is held by the tape-sending roller 42*a* and the tape-holding roller 42*b*. The tape-sending roller 42*a* has a contact surface which is to contact the polishing tape 23. This contact surface in its entirety is covered with urethane resin. This configuration increases friction with the polishing tape 23, so that the tape-sending roller 42*a* can send the polishing tape 23 without slipping. The tape-sending mechanism 42 is located downstream of a polishing point (i.e., the contact portion between the polishing tape 23 and the wafer W) with respect to a traveling direction of the polishing tape 23.

As the motor M3 rotates in a direction indicated by arrow in FIG. 4A, the tape-sending roller 42*a* rotates so as to send the polishing tape 23 from the supply reel 24 to the recovery reel 25 via the polishing head 30. The tape-holding roller 42*b* is configured to be rotatable freely about its own axis and is rotated as the polishing tape 23 is sent by the tape-sending roller 42*a*. In this manner, the rotation of the motor M 3 is converted into the tape sending operation by the friction between the polishing tape 23 and the contact surface of the tape-sending roller 42*a*, an angle of the winding of the polishing tape 23, and the grasp of the polishing tape 23 by the tape-holding roller 42*b*. Since the tape-sending mechanism 42 is provided in the polishing head 30, the position of the polishing tape 23 contacting the wafer W does not change even when the polishing head 30 moves relative to the tape supplying and recovering mechanism 2A. Only when the polishing tape 23 is being sent, the position of the polishing tape 23 contacting the wafer W changes.

Figure 4B:
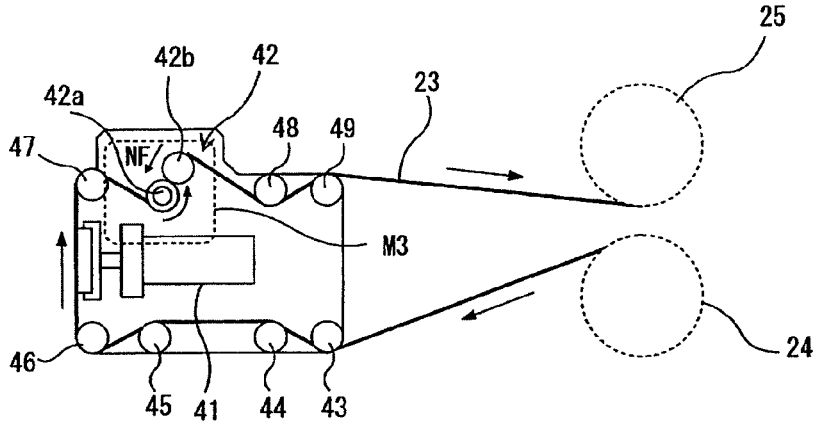
FIG. 4B is an enlarged view showing the polishing head with a polishing tape moving in an opposite direction.

FIG. 4B is an enlarged view showing the polishing head 30 with the polishing tape 23 traveling in the opposite direction. In FIG. 4A, the polishing tape 23 is sent downwardly at the contact position with the wafer W. On the other hand, in FIG. 4B, the polishing tape 23 is sent upwardly at the contact position with the wafer W. In the tape supplying and recovering mechanism 2A, the supply reel 24 is arranged above the recovery reel 25 in the case of FIG. 4A, and on the other hand, the recovery reel 25 is arranged above the supply reel 24 in the case of FIG. 4B. It is preferable that a travel direction of the polishing tape 23 be opposite in at least one of the polishing head assemblies 1A, 1B, 1C, and 1D in FIG. 1.

Figure 5:
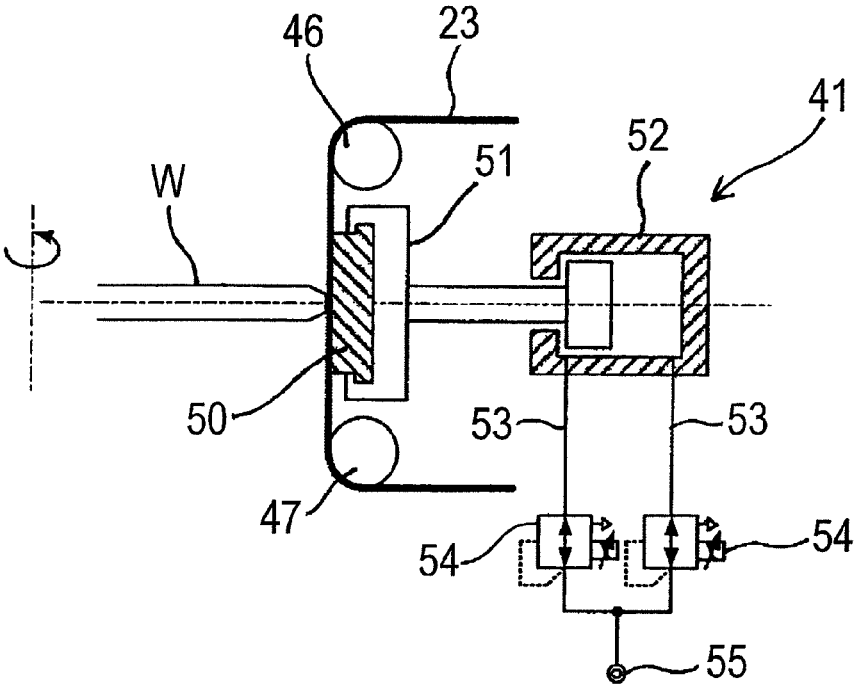
FIG. 5 is a view for illustrating a pressing mechanism of the polishing head.

FIG. 5 is a view for illustrating the pressing mechanism 41 of the polishing head 30. This pressing mechanism 41 includes a press pad 50 located behind the polishing tape 23 riding on the two guide rollers 46 and 47, a pad holder 51 configured to hold the press pad 50, and an air cylinder (actuator) 52 configured to move the pad holder 51 toward the wafer W. The guide rollers 46 and 47 are arranged at the front of the polishing head 30, and the guide roller 46 is located above the guide roller 47.

The air cylinder 52 is a so-called single rod cylinder. Two air pipes 53 are coupled to the air cylinder 52 through two ports. Electropneumatic regulators 54 are provided in the air pipes 53, respectively. Primary ends (i.e., inlet ends) of the air pipes 53 are coupled to an air supply source 55, and secondary ends (i.e., outlet ends) of the air pipes 53 are coupled to the ports of the air cylinder 52. The electropneumatic regulators 54 are controlled by signals so as to properly adjust air pressure to be supplied to the air cylinder 52. In this manner, a pressing force of the press pad 50 is controlled by the air pressure supplied to the air cylinder 52, and the polishing surface of the polishing tape 23 presses the wafer W at the controlled pressure.

As shown in FIG. 1, the polishing head 30 is fixed to one end of an arm 60, which is rotatable about an axis Ct extending parallel to the tangential line of the wafer W. The other end of the arm 60 is coupled to a motor M4 via pulleys p3 and p4 and a belt b2. As the motor M4 rotates in a clockwise direction and a counterclockwise direction through a certain angle, the arm 60 rotates about the axis Ct through a certain angle. In this embodiment, the motor M4, the arm 60, the pulleys p3 and p4, and the belt b2 constitute a tilt mechanism for tilting the polishing head 30.

As shown in FIG. 2, the tilt mechanism is mounted on a movable base 61 having a plate shape. This movable base 61 is movably coupled to a base plate 65 via guides 62 and rails 63. The rails 63 extend linearly along a radial direction of the wafer W held on the rotary holding mechanism 3, so that the movable base 61 can move along the radial direction of the wafer W. A coupling plate 66, passing through the base plate 65, is attached to the movable base 61. A linear actuator 67 is coupled to the coupling plate 66 via a joint 68. This linear actuator 67 is secured to the base plate 65 directly or indirectly.

The linear actuator 67 may comprise an air cylinder or a combination of a positioning motor and a ball screw. The linear actuator 67, the rails 63, and the guides 62 constitute a moving mechanism for linearly moving the polishing head 30 along the radial direction of the wafer W. Specifically, the moving mechanism is operable to move the polishing head 30 along the rails 63 in directions toward and away from the wafer W. On the other hand, the tape supplying and recovering mechanism 2A is fixed to the base plate 65.

The tilt mechanisms, the pressing mechanisms 41, and the tape-sending mechanisms 42 of the four polishing head assemblies 1A, 1B, 1C, and 1D arranged around the wafer W and the moving mechanisms for moving the respective polishing head assemblies are configured to operate independently of each other. Polishing operations, including a position (e.g., a polishing position and a waiting position) of the polishing head 30 in each of the polishing head assemblies 1A, 1B, 1C, and 1D, an angle of inclination of the polishing head 30, the rotational speed of the wafer W, the traveling speed of the polishing tape 23, and the polishing operation sequence of the polishing head 30, are controlled by an operation controller 69 shown in FIG. 1. While the four polishing head assemblies and the four tape supplying and recovering mechanisms are provided in this embodiment, the present invention is not limited to this arrangement. For example, two pairs, three pairs, or more than four pairs of the polishing head assemblies and the tape supplying and recovering mechanisms may be provided.

In this polishing apparatus as described above, when the polishing head 30 is tilted by the tilt mechanism, a portion of the polishing tape 23 held by the tape-sending roller 42*a* and the tape-holding roller 42*b* is tilted as well. Therefore, the portion of the polishing tape 23 contacting the wafer W does not change in its position relative to the polishing head 30 during the tilting motion of the polishing head 30, while the supply reel 24 and the recovery reel 25, which are fixed in position, wind or supply the polishing tape 23. Similarly, when the polishing head assembly 1A is moved by the moving mechanism in the radial direction of the wafer W, the polishing tape 23 held by the tape-sending roller 42*a* and the tape-holding roller 42*b* is also moved together. Therefore, while the polishing head assembly 1A is moved, the supply reel 24 and the recovery reel 25 only wind or supply the polishing tape 23.

Since the position of the polishing tape 23 relative to the polishing head 30 does not change even when the polishing head 30 is tilted and moved linearly, the polishing surface, once used in polishing, is not used in polishing again. Therefore, a new polishing surface of the polishing tape 23 can be used continuously. Further, since the motors M2 and the reels 24 and 25 of the tape supplying and recovering mechanism 2A do not need to be tilted together with the polishing head 30, the tilt mechanism can be small in size. For the same reason, the moving mechanism can also be compact. Since the supply reel 24 and the recovery reel 25 do not need to be tilted and moved, the supply reel 24 and the recovery reel 25 can be large in size. Therefore, a long polishing tape 23 can be used, thus reducing frequency of replacement operations of the polishing tape 23. Further, since the supply reel 24 and the recovery reel 25 of the tape supplying and recovering mechanism 2A are fixed in position and located outside the polishing room 21, the replacement operations of the polishing tape 23, which is a consumable part, becomes easy.

Figure 6:
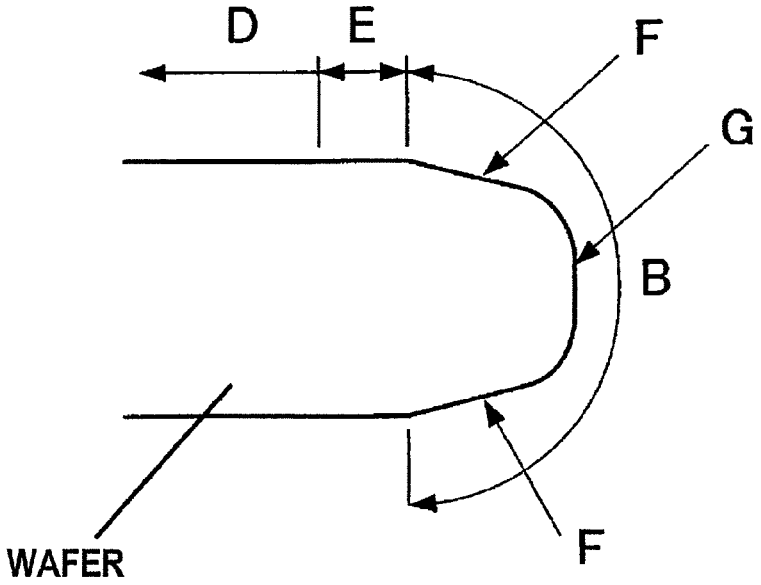
FIG. 6 is an enlarged cross-sectional view showing a periphery of a wafer.

The polishing apparatus according to the first embodiment as described above is suitable for use in polishing a bevel portion of the wafer W. FIG. 6 is an enlarged cross-sectional view showing the periphery of the wafer W. An area where devices are formed is a flat portion D located inwardly of an edge surface G by several millimeters. As shown in FIG. 6, in this specification, a flat portion outwardly of the device formation area is defined as a near edge portion E, and an inclined portion including an upper slope F, the edge surface G, and a lower slope F is defined as a bevel portion B.

Figure 7A:
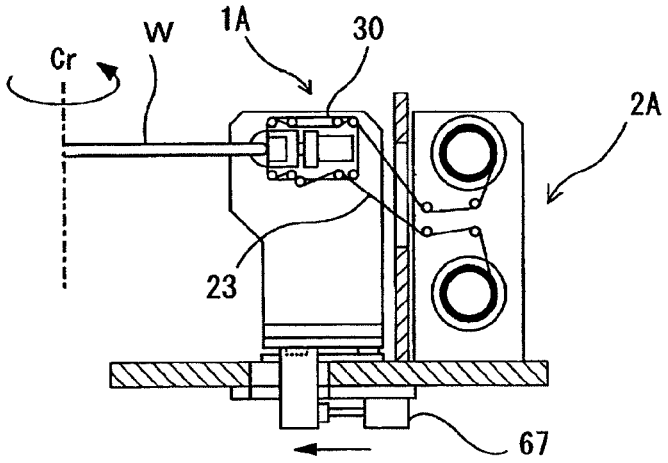
FIG. 7A is a view showing a state in which a polishing head assembly is moved forward by a linear actuator so as to press a polishing tape against a bevel portion of a wafer.
Figure 7B:
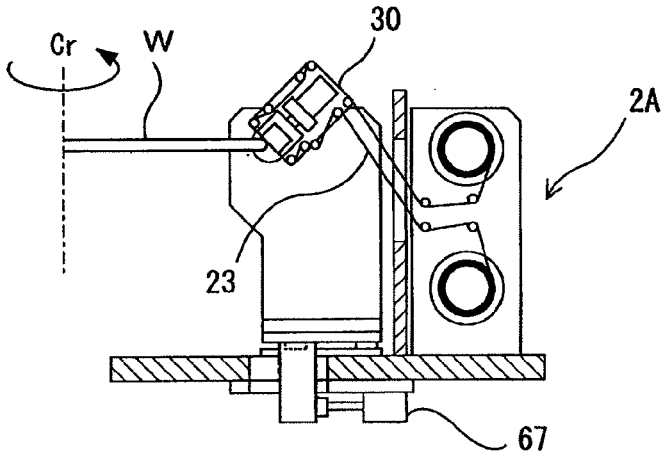
FIG. 7B is a view showing a state in which the polishing head is tilted by a tilt mechanism so as to press the polishing tape against an upper slope of the bevel portion of the wafer.
Figure 7C:
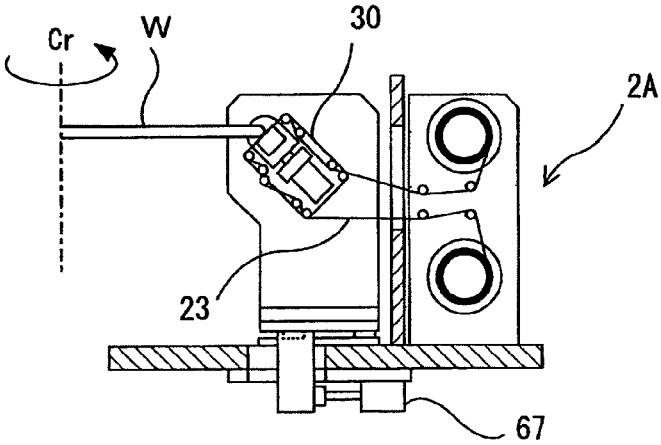
FIG. 7C is a view showing a state in which the polishing head is tilted by the tilt mechanism so as to press the polishing tape against a lower slope of the bevel portion of the wafer.

FIG. 7A is a view showing a state in which the polishing head assembly 1A is moved forward by the linear actuator 67 so as to press the polishing tape 23 against the bevel portion of the wafer W. The rotary holding mechanism 3 rotates the wafer W thereon so as to provide relative movement between the polishing tape 23 and the bevel portion of the wafer W, thereby polishing the bevel portion. FIG. 7B is a view showing a state in which the polishing head 30 is tilted by the tilt mechanism so as to press the polishing tape 23 against the upper slope of the bevel portion. FIG. 7C is a view showing a state in which the polishing head 30 is tilted by the tilt mechanism so as to press the polishing tape 23 against the lower slope of the bevel portion. The motor M4 of the tilt mechanism is a servo motor or a stepping motor which can accurately control its rotational position and speed. Therefore, the polishing head 30 can rotate through a desired angle at a desired speed as programmed so as to change its position.

Figure 8A:
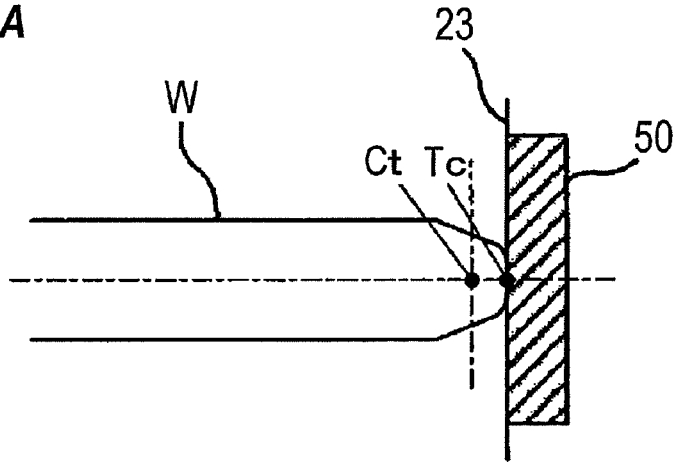
FIGS. 8A through 8C are enlarged schematic views each showing a contact portion between the bevel portion and the polishing tape, FIGS. 8A through 8C corresponding to FIGS. 7A through 7C.
Figure 8B:
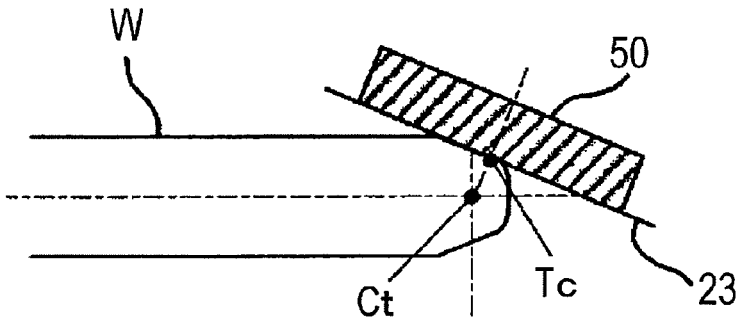
Figure 8C:
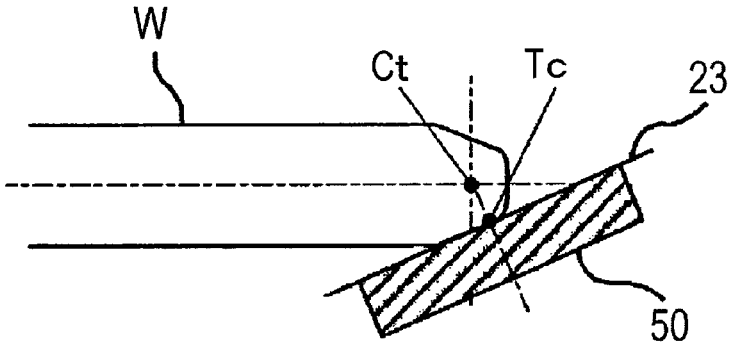

FIGS. 8A through 8C are enlarged schematic views each showing the contact portion between the bevel portion of the wafer W and the polishing tape 23. FIGS. 8A through 8C correspond to FIGS. 7A through 7C, respectively. The polishing head 30 is rotated about the axis Ct in the drawings by the tilt mechanism. FIG. 8A shows a state in which the polishing head 30 is in such an angle that the polishing tape 23 and the edge surface of the bevel portion are parallel to each other. FIG. 8B shows a state in which the polishing head 30 is in such an angle that the polishing tape 23 and the upper slope of the bevel portion are parallel to each other. FIG. 8C shows a state in which the polishing head 30 is in such an angle that the polishing tape 23 and the lower slope of the bevel portion are parallel to each other.

In this manner, the polishing head 30 can change its angle of inclination in accordance with the shape of the bevel portion of the wafer W. Therefore, the polishing head 30 can polish a desired area in the bevel portion. When a bevel portion has a curved cross section, it is possible to change the angle of the polishing head 30 little by little during polishing, or to change the angle of the polishing head 30 continuously at a slow speed during polishing.

The rotational center of the tilt mechanism lies in the wafer W as indicated by the axis Ct in FIGS. 8A through 8C. The polishing head 30 rotates (i.e., leans) about this axis Ct. Therefore, in the positional relationship as shown in FIGS. 8A through 8C, a point on the polishing tape 23 rotates about the axis Ct as well. For example, as shown in FIGS. 8A through 8C, a point Tc on the polishing tape 23, which is on a central line of the polishing head 30, rotates together with the polishing head 30. During rotation, the point Tc as viewed from the polishing head 30 is in the same position on the central line of the polishing head 30. In other words, a relative position between the point Tc on the polishing tape 23 and the polishing head 30 does not change. This means that the portion of the polishing tape 23 on the central line of the polishing head 30 can contact the wafer W even when the polishing head 30 is tilted by the tilt mechanism. Because the contact position does not change while the polishing head 30 is being tilted, the polishing tape 23 can be used efficiently. The position of the rotational axis Ct of the polishing head 30 can be established at a desired position by the moving mechanism.

Figure 9:
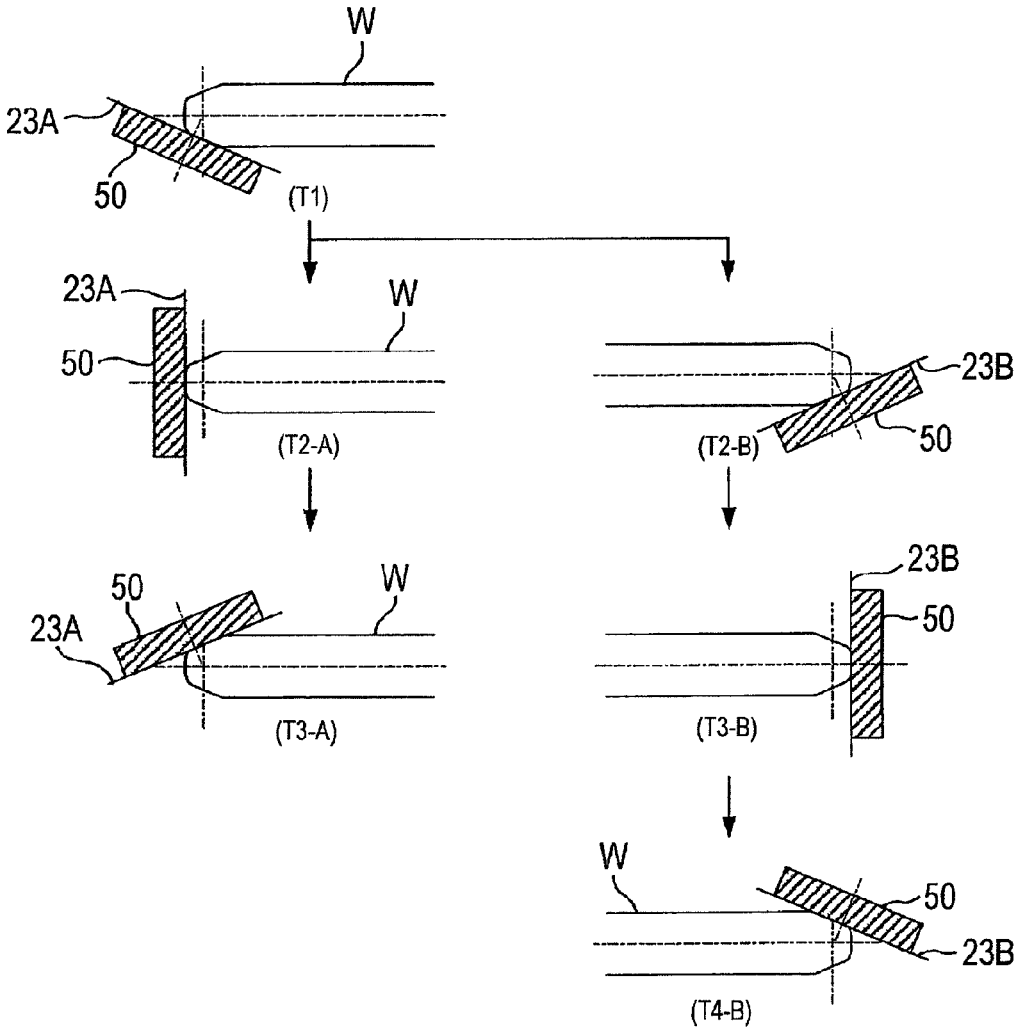
FIG. 9 is a view showing a sequence of polishing operations when plural polishing heads simultaneously polish the wafer held by a rotary holding mechanism.

Next, a preferred example of the polishing operations performed by the polishing apparatus according to the embodiment will be described with reference to FIG. 9. FIG. 9 is a view showing a sequence of polishing operations when the multiple polishing heads 30 are used to simultaneously polish the wafer W held by the rotary holding mechanism 3. In FIG. 9, symbols T1, T2, T3, T4 represent a time.

As shown in FIG. 9, at a time T1, the polishing head assembly 1A polishes the lower slope of the bevel portion using a polishing tape 23A having rough abrasive grains. Thereafter, at a time T2-A, the polishing head 30 of the polishing head assembly 1A changes its angle of inclination by the tilt mechanism and polishes the edge surface of the bevel portion. At this time, the polishing head 30 of the polishing head assembly 1B with a polishing tape 23B having fine abrasive grains is moved toward the wafer W until the polishing tape 23B comes into contact with the lower slope, that has been already polished by the polishing tape 23A, and polishes the lower slope with the polishing tape 23B (T2-B). Then, the polishing head 30 of the polishing head assembly 1A changes its angle of inclination and polishes the upper slope of the bevel portion (T3-A). At the same time, the polishing head 30 of the polishing head assembly 1B changes its angle of inclination and polishes the edge surface of the bevel portion (T3-B). Finally, the polishing head 30 of the polishing head assembly 1B changes its angle of inclination and polishes the upper slope of the bevel portion (T4-B).

In this manner, right after rough polishing of a first area in the bevel portion is terminated, rough polishing of a second area and finish polishing of the first area can be started simultaneously. As a result, a total polishing time can be shortened. When the four polishing heads 30 are provided as in this embodiment, it is possible to mount the polishing tapes 23A having rough abrasive grains on two of the four polishing heads 30 and mount the polishing tapes 23B having fine abrasive grains on the other two polishing heads 30. It is also possible to perform multi-step polishing (e.g., three-step polishing or four-step polishing) by bringing multiple polishing tapes having abrasive grains with different roughness into contact with the wafer W successively in the order of decreasing a size of the abrasive grains. Further, it is possible to use plural polishing tapes having abrasive grains with the same roughness. When rough polishing is expected to require a long time, it is possible to perform the rough polishing by the plural polishing head assemblies.

Instead of the polishing tape 23, a tape-like cleaning cloth may be mounted on at least one of the polishing head assemblies 1A, 1B, 1C, and 1D. This cleaning cloth is a cleaning tool for removing particles or debris generated by the polishing process. In this case, the cleaning cloth can be used for the finishing process so as to clean the polished portion of the wafer W in the same manner as described above. With this method, polishing and cleaning can be performed in a shortened period of time. The tape-like cleaning cloth may comprise a tape base, such as a PET film, and a layer of polyurethane foam or nonwoven cloth on the tape base.

A polishing tape comprising a tape-like polishing cloth having a layer of polyurethane foam or nonwoven cloth, as with the above-mentioned tape-like cleaning cloth, may be used instead of the polishing tape 23 having the abrasive grains. In this case, a polishing liquid (slurry) containing abrasive grains is supplied onto the wafer W during polishing. The slurry can be supplied onto the upper surface of the wafer W during polishing using a slurry supply nozzle provided in a position similar to the upper supply nozzle 36.

Figure 10:
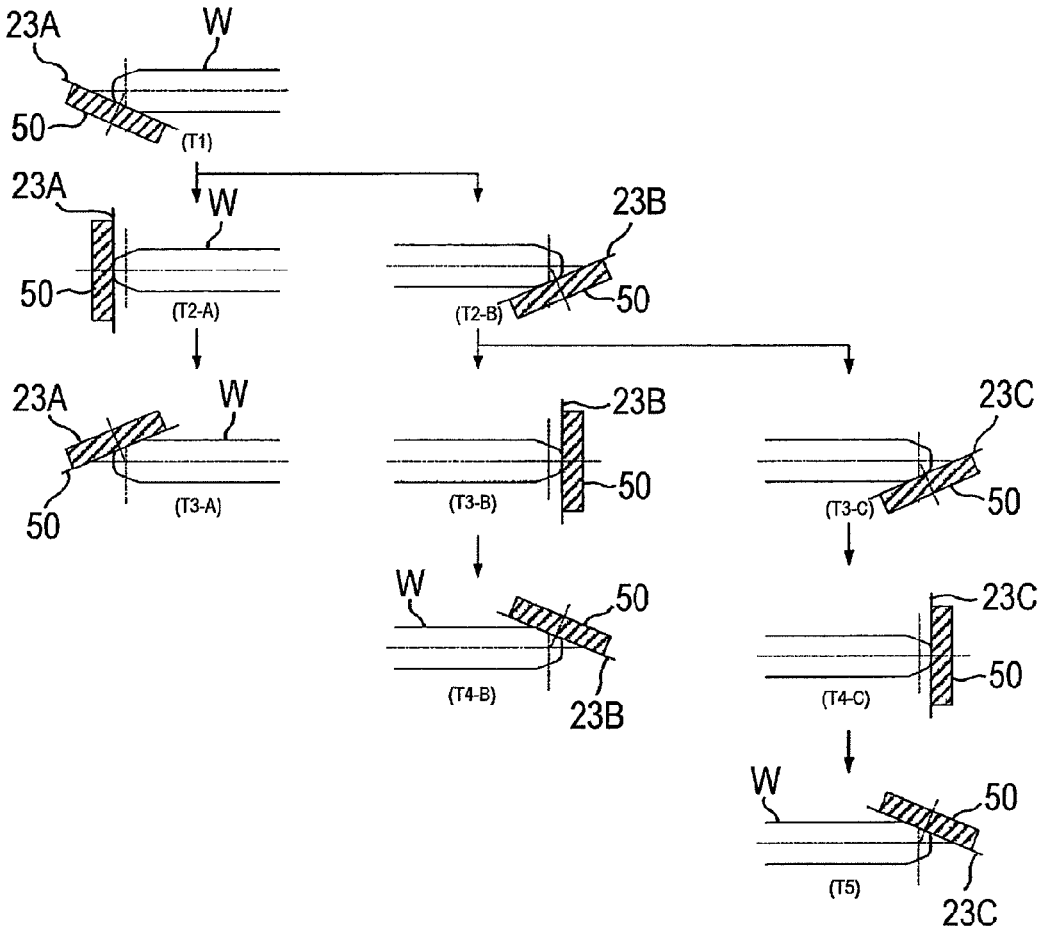
FIG. 10 is a view showing a sequence of polishing operations when performing three-step polishing using three polishing tapes having abrasive grains with different roughness.

FIG. 10 is a view showing a polishing sequence when performing three-step polishing using three polishing tapes 23A, 23B, and 23C having abrasive grains with different roughness. In the polishing head assembly 1A, the polishing tape 23A having rough abrasive grains is used to perform rough polishing (i.e., first polishing) of the wafer W. Then, second polishing is started using the polishing tape 23B having finer abrasive grains than those of the polishing tape 23A so as to polish the portion that has been polished by the polishing tape 23A. Then, third polishing is started using the polishing tape 23C having finer abrasive grains than those of the polishing tape 23B so as to perform finish polishing of the portion that has been polished by the polishing tape 23B. In FIG. 10, symbols T1, T2, T3, T4, T5 represent a time. For example, at the time T3, the three polishing heads 30 simultaneously polish the wafer W.

Figure 11A:
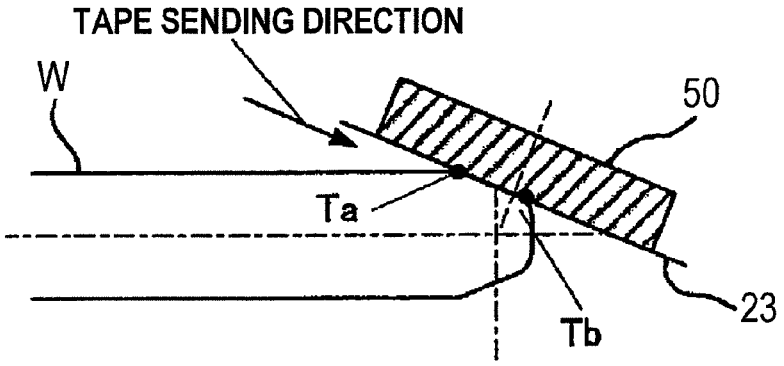
FIG. 11A is a view showing a state in which the upper slope of the bevel portion is being polished.
Figure 11B:
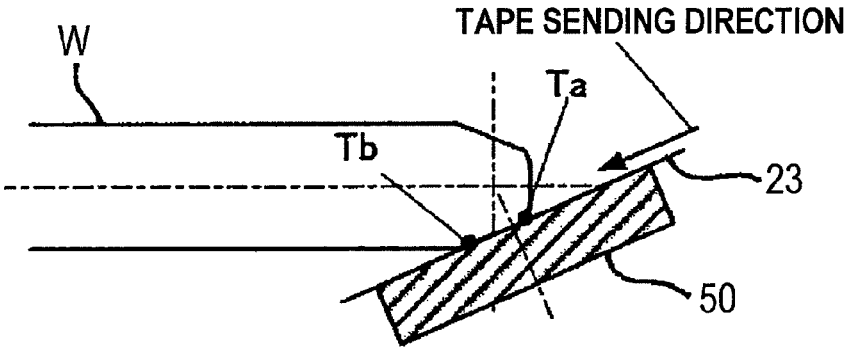
FIG. 11B is a view showing a state in which the lower slope of the bevel portion is being polished.

FIG. 11A is a view showing a state in which the upper slope of the bevel portion is being polished, and FIG. 11B is a view showing a state in which the lower slope of the bevel portion is being polished. In FIGS. 11A and 11B, the traveling directions of the polishing tapes 23 are the same as each other. In this case, the polishing tape 23 is brought into contact with the wafer W at a position Ta, and is separated from the wafer W at a position Tb. Accordingly, the tape-contact starting position Ta and the tape-contact ending position Tb during polishing of the upper slope and the tape-contact starting position Ta and the tape-contact ending position Tb during polishing of the lower slope are not symmetric about a horizontal center line of the wafer W. Since the debris is deposited on the polishing tape 23 during polishing, this polishing method may result in an asymmetric polishing profile with different finishing shapes in the upper slope and the lower slope.

Figure 12A:
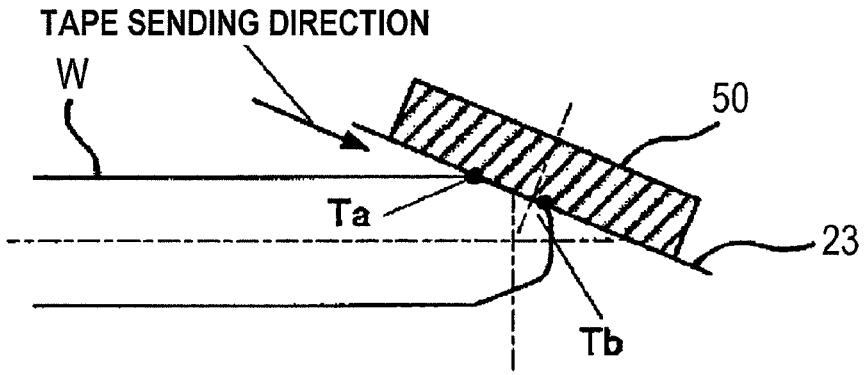
FIG. 12A is a view showing a state in which the upper slope of the bevel portion is being polished by a first polishing head.
Figure 12B:
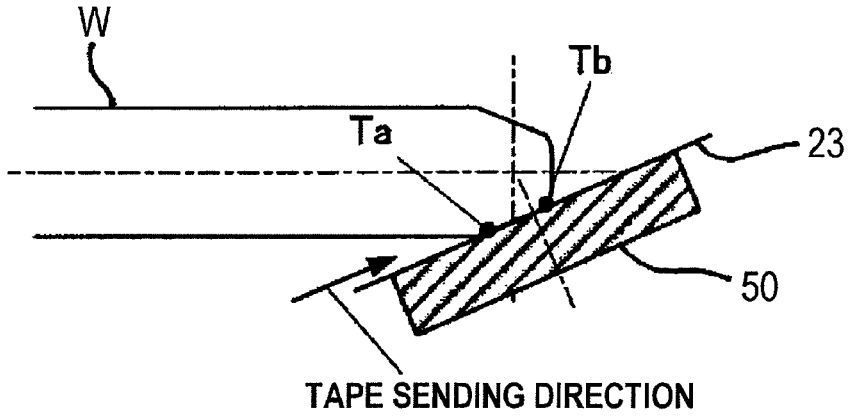
FIG. 12B is a view showing a state in which the lower slope of the bevel portion is being polished by a second polishing head with a polishing tape moving in an opposite direction.

FIG. 12A is a view showing a state in which the upper slope of the bevel portion is being polished by the polishing head 30, and FIG. 12B is a view showing a state in which the lower slope of the bevel portion is being polished by another polishing head 30, while the polishing tape 23 is traveling in a direction opposite to the direction in FIG. 12A. Two polishing heads 30 are inclined by the tilt mechanisms at angles that are symmetric about the horizontal center line of the wafer W. In this example, the tape-contact starting positions Ta and the tape-contact ending positions Tb in FIGS. 12A and 12B are symmetric about the horizontal center line of the wafer W. Therefore, the upper slope and the lower slope can have a symmetric polishing profile. Instead of inclining the polishing heads 30 at the symmetric angles as shown in FIGS. 12A and 12B, it is possible to incline the polishing heads 30 at the same angle so as to polish the same surface (e.g., the upper slope). In this case also, the same effect can be obtained.

Figure 13:
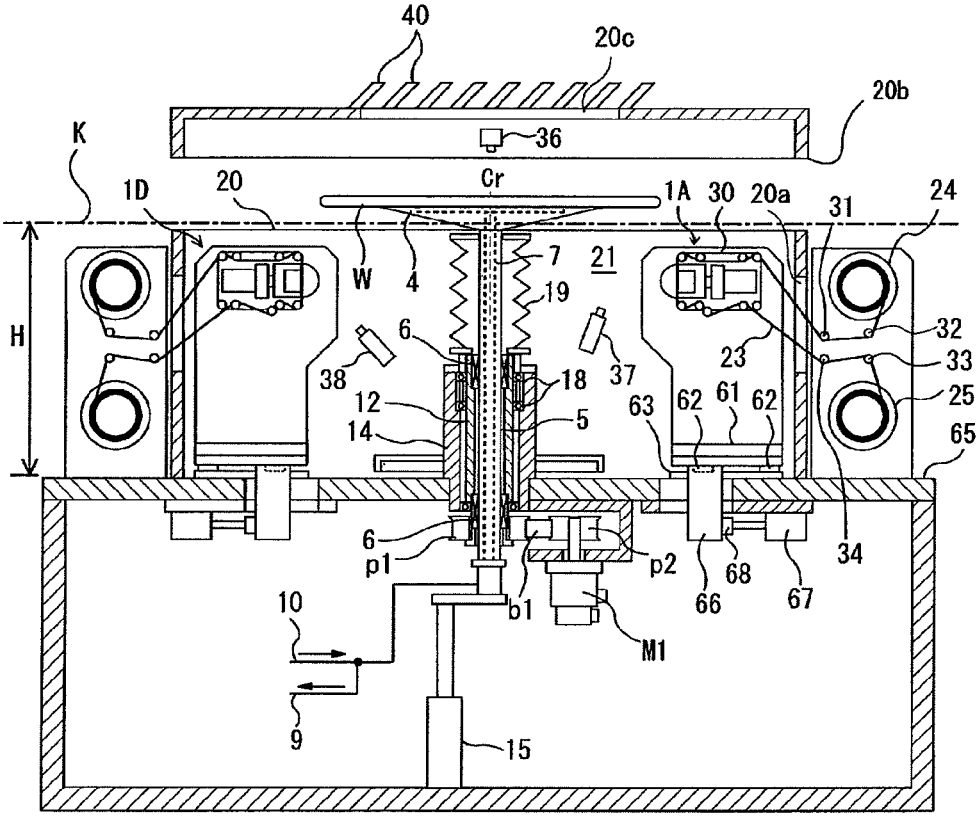
FIG. 13 is a cross-sectional view showing the polishing apparatus with a holding stage being in an elevated position.

FIG. 13 is a cross-sectional view showing the polishing apparatus with the holding stage 4 being in an elevated position. After polishing, the polishing head assemblies 1A, 1B, 1C, and 1D are moved backward by the moving mechanisms. Then, the polishing heads 30 are retuned to a horizontal position by the tilt mechanisms, and the holding stage 4 is elevated to the transfer position by the air cylinder 15, as shown in FIG. 13. In this transfer position, the wafer W is grasped by the hands (which will be described later) of the transfer mechanism and the wafer W is released from the holding stage 4. The wafer W, removed from the holding stage 4, is transferred to an adjacent cleaning unit (which will be described later) by the transfer mechanism.

As shown in FIG. 13, a horizontal plane K (indicated by a dash-dot line) is established in advance in the polishing apparatus. The horizontal plane K lies at a distance H from the upper surface of the base plate 65. This horizontal plane K is a virtual plane across the polishing room 21. The holding stage 4 is elevated to a position higher than the horizontal plane K. On the other hand, the polishing heads 30 are rotated by the tilting mechanisms so that the polishing head assemblies 1A, 1B, 1C, and 1D lie in a position lower than the horizontal plane K. The tape supplying and recovering mechanisms 2A, 2B, 2C, and 2D are also arranged below the horizontal plane K.

As described above, the upper surface of the partition wall 20 has the opening 20*c* and the louvers 40, and the lower surface of the partition wall 20 has the gas-discharge opening 20*e* (see FIG. 3). The transfer opening 20*b* is closed by the non-illustrated shutter during the polishing process. A fan mechanism (not shown in the drawing) is provided so as to evacuate a gas from the polishing room 21 through the gas-discharge opening 20*e*, so that downward flow of a clean air is formed in the polishing room 21. Because the polishing process is performed in this state, the polishing liquid is prevented from scattering upwardly. Therefore, the polishing process can be performed while keeping an upper space of the polishing room 21 clean.

The horizontal plane K is the virtual plane that separates the upper space, which is less contaminated, from a lower space which is contaminated by the polishing debris produced by the polishing process. In other words, the clean upper space and the dirty lower space are divided by the horizontal plane K. After the wafer W and the holding stage 4 are elevated to the clean position (i.e., above the horizontal plane K), the wafer W is transferred. Therefore, the hands of the transfer mechanism are not contaminated. After the polishing process, the wafer W is elevated while the shutter is kept closed, and then the cleaning water (i.e., the cleaning liquid) is ejected from the cleaning nozzles 38 so as to clean the polishing heads 30. With these operations, the dirty polishing heads 30 are cleaned in the less clean position (i.e., below the horizontal plane K) without contaminating the processed wafer W. After cleaning, the shutter is opened and the wafer W is transferred by the transfer mechanism.

Next, a second embodiment of the present invention will be described.

Figure 14:
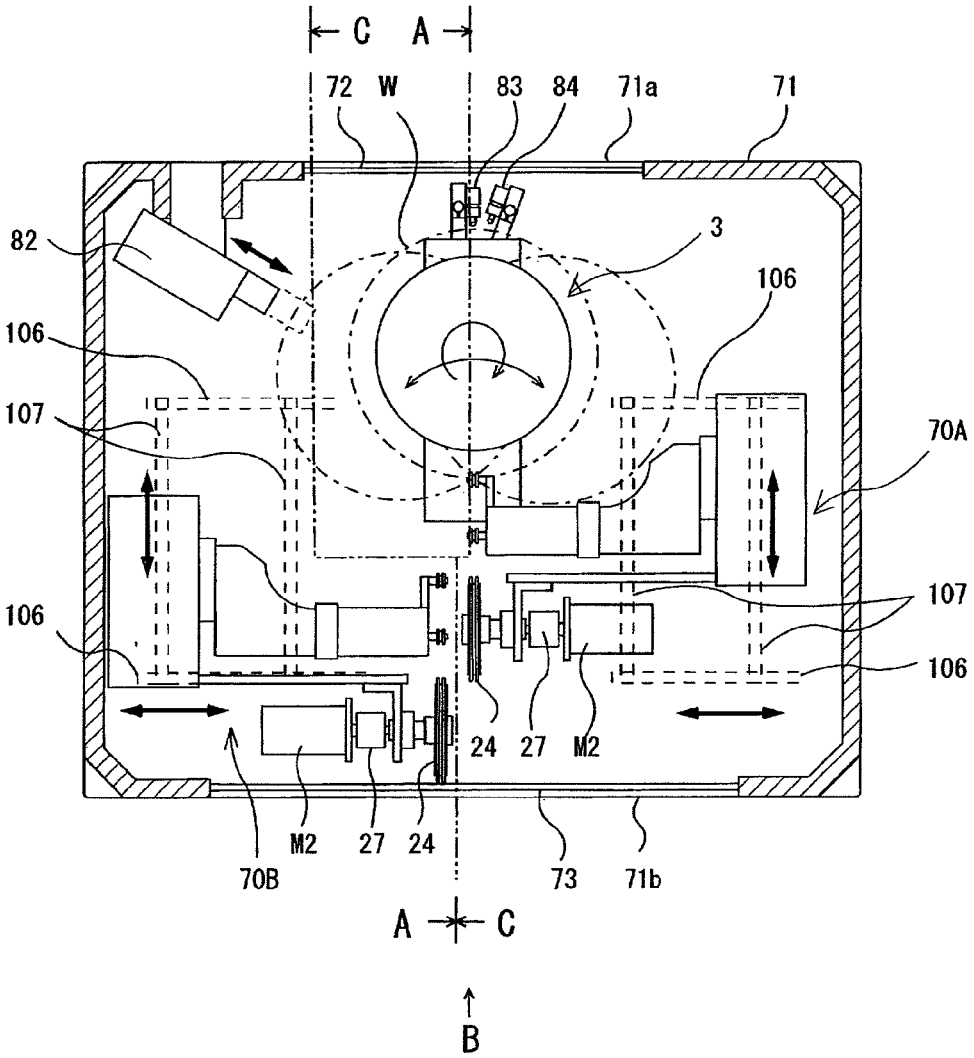
FIG. 14 is a plan view showing a polishing apparatus according to a second embodiment of the present invention.
Figure 15:
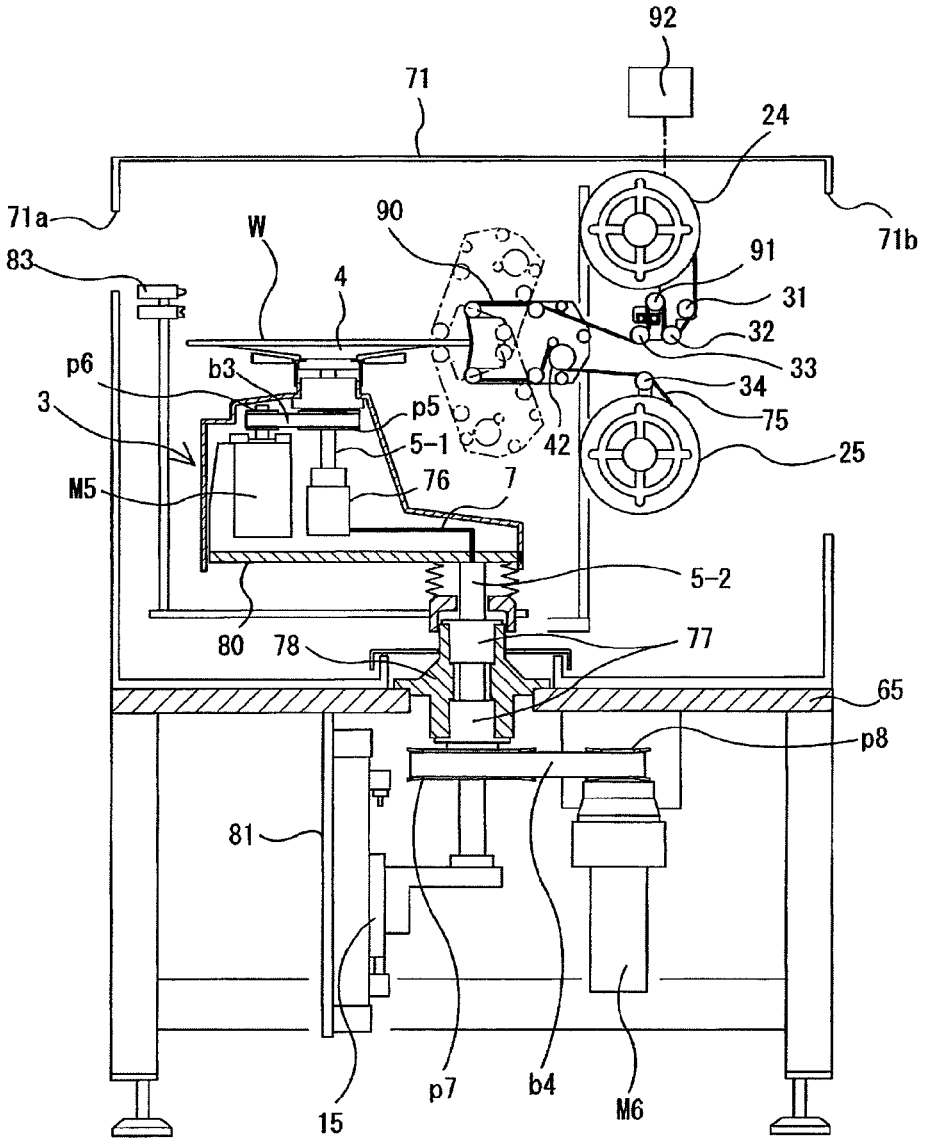
FIG. 15 is a cross-sectional view taken along line A-A in FIG. 14.
Figure 16:
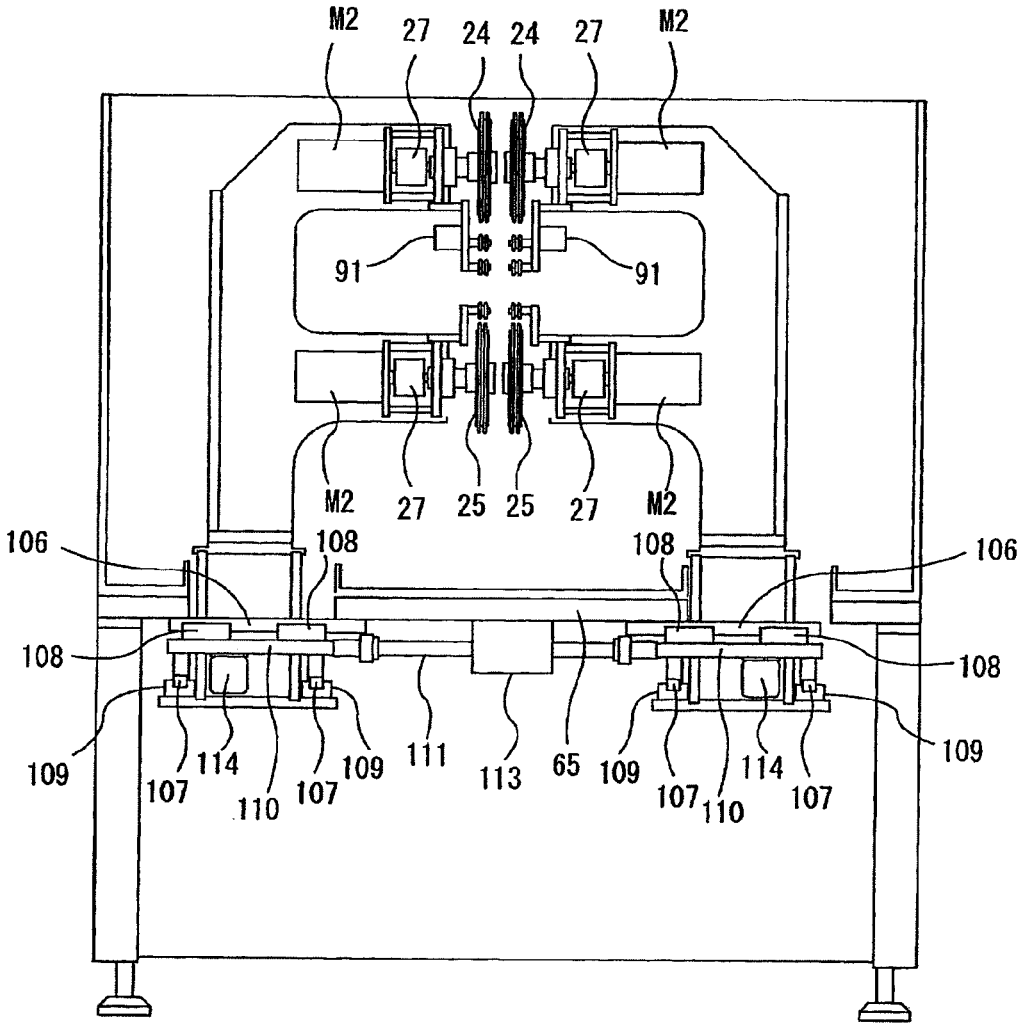
FIG. 16 is a side view of the polishing apparatus as viewed from a direction indicated by arrow B in FIG. 14.
Figure 17:
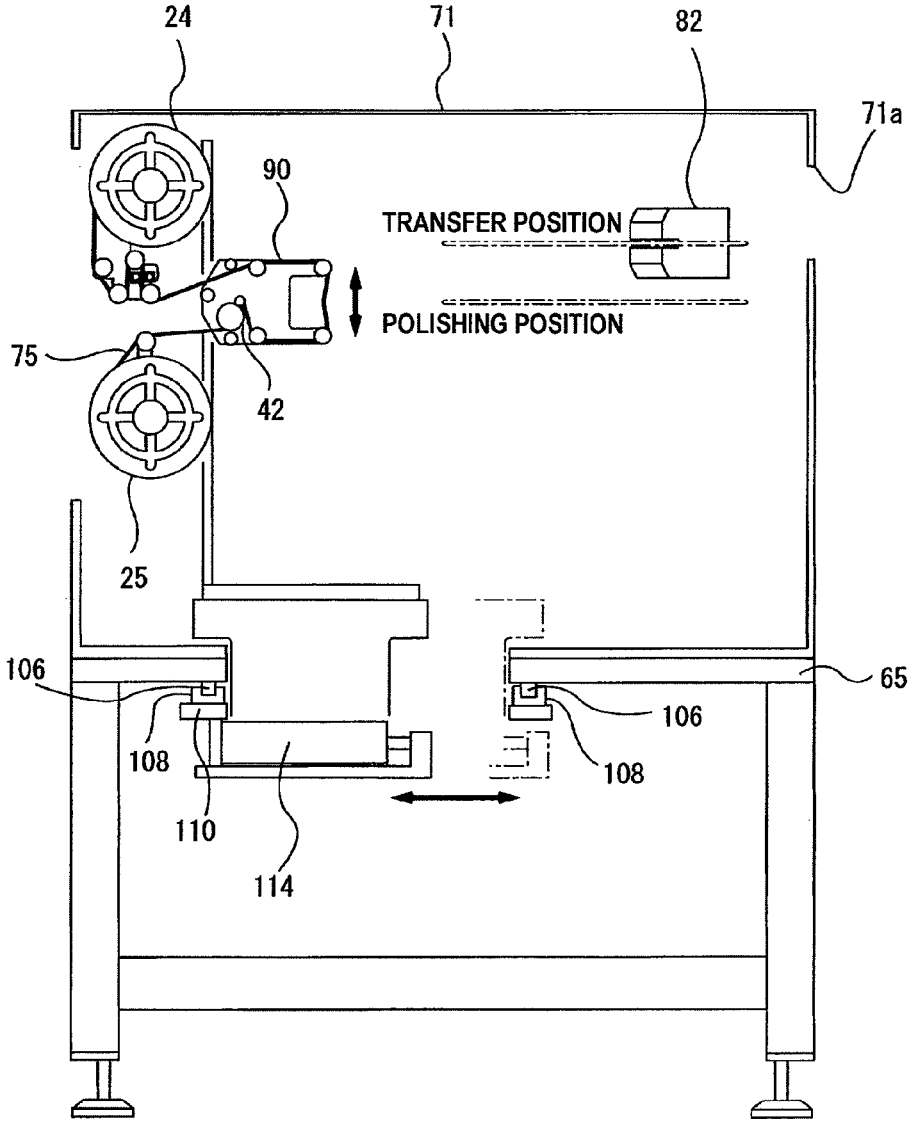
FIG. 17 is a cross-sectional view taken along line C-C in FIG. 14.

FIG. 14 is a plan view showing a polishing apparatus according to the second embodiment of the present invention. FIG. 15 is a cross-sectional view taken along line A-A in FIG. 14. FIG. 16 is a side view of the polishing apparatus as viewed from a direction indicated by arrow B in FIG. 14. FIG. 17 is a cross-sectional view taken along line C-C in FIG. 14. Elements that are identical or similar to those of the first embodiment are denoted by the same reference numerals, and will not be described repetitively. In addition, structures and operations of this embodiment, which will not be described below, are the same as those of the first embodiment described above.

The polishing apparatus according to this embodiment is suitable for use in polishing of a notch portion formed in a periphery of a wafer W. As shown in FIG. 14, this polishing apparatus includes two polishing head modules 70A and 70B, and rotary holding mechanism 3 configured to hold and rotate the wafer W. These polishing head modules 70A and 70B and the rotary holding mechanism 3 are housed in a housing 71. This housing 71 has a transfer opening 71*a* for use in carrying the wafer W in and out the housing 71. A shutter 72 is provided so as to cover the transfer opening 71*a*. The housing 71 has an operation window 71*b* for use in replacement of a polishing tape. A shutter 73 is provided so as to close the operation window 71*b*.

As shown in FIG. 15, the holding stage 4 is coupled to an upper end of a first hollow shaft 5-1. This first hollow shaft 5-1 is coupled to a motor M5 via pulleys p5 and p6 and a belt b3, so that the holding stage 4 is rotated by the motor M5. The holding stage 4, the first hollow shaft 5-1, the pulleys p5 and p6, the belt b3, and the motor M5 constitute a stage assembly.

A second hollow shaft 5-2 is provided below the first hollow shaft 5-1. The first hollow shaft 5-1 and the second hollow shaft 5-2 extend parallel to each other. The first hollow shaft 5-1 and the second hollow shaft 5-2 are coupled to each other by a communication line 7 via a rotary joint 76. As with the first embodiment, one end of the communication line 7 is coupled to grooves (see FIG. 2) formed on an upper surface of the holding stage 4, and the other end is coupled to vacuum line 9 and nitrogen-gas supply line 10 (see FIG. 2). By selectively coupling the vacuum line 9 or the nitrogen-gas supply line 10 to the communication line 7, the wafer W is attracted to the upper surface of the holding stage 4 by a vacuum suction or released from the upper surface of the holding stage 4.

The second hollow shaft 5-2 is supported by rotary ball spline bearings 77, which allow the second hollow shaft 5-2 to rotate and linearly move. The rotary ball spline bearings 77 are supported by a casing 78, which is fixed to base plate 65. The second hollow shaft 5-2 is coupled to a motor M6 via pulleys p7 and p8 and a belt b4, so that the second hollow shaft 5-2 is rotated by the motor M6.

The stage assembly and the second hollow shaft 5-2 are coupled to each other via an arm 80. The motor M6 is controlled so as to rotate the second hollow shaft 5-2 through a predetermined angle in a clockwise direction and a counterclockwise direction. Therefore, as the motor M6 causes the second hollow shaft 5-2 to rotate in the clockwise direction and the counterclockwise direction, the stage assembly also rotates in the clockwise direction and the counterclockwise direction. An axis of the first hollow shaft 5-1 and an axis of the second hollow shaft 5-2 are not aligned with each other. A notch portion of the wafer W held on the holding stage 4 lies on an extension of the second hollow shaft 5-2. Therefore, as the motor M6 is energized, the wafer W rotates about its notch portion in a horizontal plane through a predetermined angle in the clockwise direction and the counterclockwise direction (i.e., the wafer W swings). In this embodiment, a swinging mechanism for swinging the wafer W around the notch portion thereof is constituted by the pulleys p7 and p8, the belt b4, the motor M6, the second hollow shaft 5-2, the arm 80, and other elements.

The second hollow shaft 5-2 is coupled to air cylinder (elevating mechanism) 15, so that the second hollow shaft 5-2 and the stage assembly are elevated and lowered by the air cylinder 15. This air cylinder 15 is mounted on a frame 81 that is fixed to the base plate 65. As shown in FIG. 17, the wafer W on the holding stage 4 is moved vertically between the transfer position and the polishing position. More specifically, when the wafer W is to be transferred, the wafer W is elevated to the transfer position by the air cylinder 15, and when the W is to be polished, the wafer W is lowered to the polishing position by the air cylinder 15. The transfer opening 71*a* of the housing 71 is provided at the same height as the transfer position.

The rotary holding mechanism 3 further includes a rinsing-liquid supply nozzle 83 and a chemical-liquid supply nozzle 84. A ringing liquid, such as pure water, is supplied from the rinsing-liquid supply nozzle 83 onto the wafer W on the holding stage 4, and a chemical liquid is supplied from the chemical-liquid supply nozzle 84 onto the wafer W on the holding stage 4. These rinsing-liquid supply nozzle 83, the chemical-liquid supply nozzle 84, and the holding stage 4 are rotated integrally about the notch portion through the predetermined angle by the swinging mechanism.

A notch searching unit 82 for detecting the notch portion formed in the wafer W is provided at the transfer position of the wafer W. A non-illustrated actuator is provided for moving the notch searching unit 82 between a notch searching position and a waiting position, as shown in FIG. 14. When the notch searching unit 82 detects the notch portion of the wafer W, the holding stage 4 is rotated by the motor M5 such that the notch portion faces the polishing head modules 70A and 70B. As shown in FIG. 17, the notch searching unit 82 detects the notch portion when the wafer W is in the transfer position.

Conventionally, a notch searching unit is provided at the polishing position. As a result, a rinsing liquid and a chemical liquid can be attached to the notch searching unit, causing an error in detecting the position of the notch portion. According to the embodiment of the present invention, because the notch searching unit 82 is located at the transfer position above the polishing position, the rinsing liquid and the chemical liquid are not attached to the notch searching unit 82. Hence, the detection error in the notch searching unit 82 due to the rinsing liquid or the chemical liquid can be prevented.

As shown in FIG. 14, the two polishing head modules 70A and 70B are symmetric about the notch portion of the wafer W. These polishing head modules 70A and 70B have the same structure. Therefore, only the polishing head module 70A will be described in detail below.

The polishing head module 70A includes a polishing head 90 configured to bring a polishing tape 75 into sliding contact with the notch portion of the wafer W, a supply reel 24 for supplying the polishing tape 75 to the polishing head 90, and a recovery reel 25 for recovering the polishing tape 75 that has been used in polishing of the wafer W. The supply reel 24 and the recovery reel 25 are arranged outwardly of the polishing head 90 with respect to a radial direction of the wafer W. The supply reel 24 is arranged above the recovery reel 25. Motors M2 are coupled respectively to the supply reel 24 and the recovery reel 25 via couplings 27. Each of the motors M2 is configured to generate a constant torque in a predetermined rotational direction so as to apply a predetermined tension to the polishing tape 75. In this embodiment also, a tape supplying and recovering mechanism is constituted by the supply reel 24, the recovery reel 25, the couplings 27, the motors M2, and other elements.

Guide rollers 31, 32, and 33 and a tension sensor 91 are arranged between the polishing head 90 and the supply reel 24. A guide roller 34 is arranged between the polishing head 90 and the recovery reel 25. The tension (i.e. a polishing load) exerted on the polishing tape 75 is measured by the tension sensor 91. An output signal of the tension sensor 91 is sent to a monitoring unit 92, which monitors the tension of the polishing tape 75. The polishing tape 75, which is used in this embodiment, is narrower than the polishing tape 23 that is used in the first embodiment.

Figure 18:
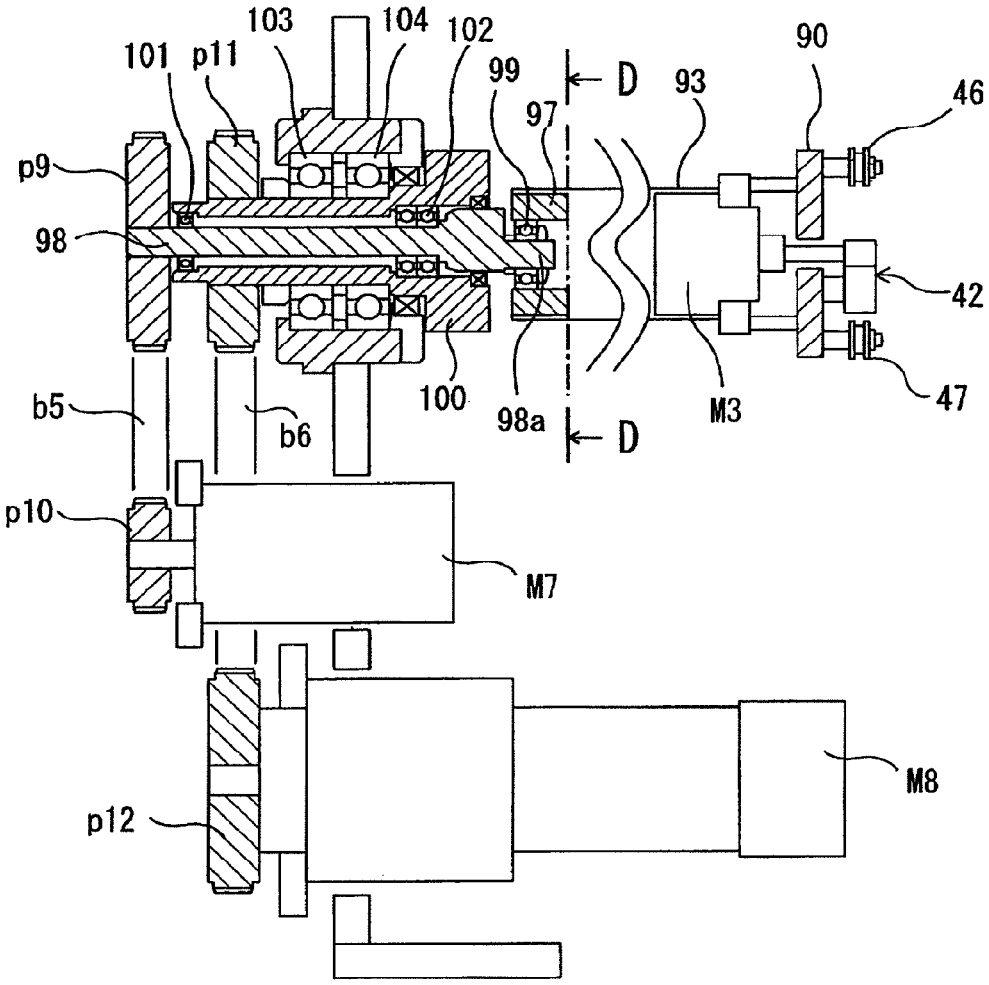
FIG. 18 is a cross-sectional view showing a polishing head module.
Figure 19:
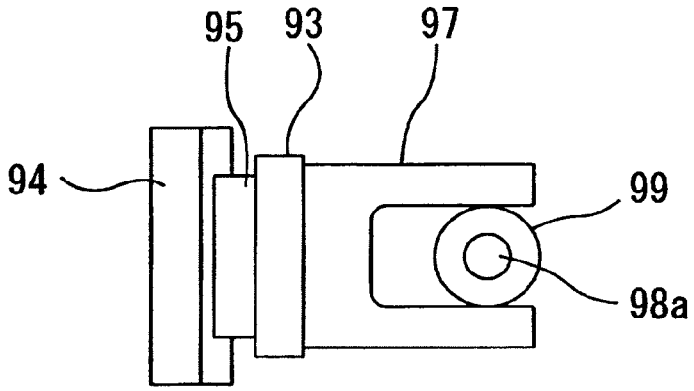
FIG. 19 is a cross-sectional view taken along line D-D in FIG. 18.

FIG. 18 is a cross-sectional view showing the polishing head module, and FIG. 19 is a cross-sectional view taken along line D-D in FIG. 18. As shown in FIG. 18, the polishing head 90 has tape-sending mechanism 42, and guide rollers 46 and 47. The polishing head 90 has a basic structure identical to the polishing head 30 in the first embodiment, but is different from the polishing head 30 in that the polishing head 90 does not include the pressing mechanism. As shown in FIG. 18 and FIG. 19, the polishing head 90 is fixed to an oscillation plate 93, which is coupled to a tilt plate 94 via at least one linear guide 95. A U-shaped oscillation-receiving block 97 is fixed to one end of the oscillation plate 93. An oscillation shaft 98 having an eccentric shaft 98*a* is coupled to the oscillation-receiving block 97. A bearing 99 is mounted on the eccentric shaft 98*a*, and this bearing 99 engages a rectangular housing space formed in the oscillation-receiving block 97. The bearing 99 is shaped so as to roughly fit in the housing space.

The oscillation shaft 98 is coupled to a motor M7 via pulleys p9 and p10 and a belt b5. The oscillation shaft 98 is rotated by the motor M7, and the eccentric shaft 98*a* of the oscillation shaft 98 performs eccentric rotation. This eccentric rotation of the eccentric shaft 98*a* is converted into a linear reciprocating motion of the oscillation plate 93 by the linear guide 95, whereby the polishing head 90, that is secured to the oscillation plate 93, performs a linear reciprocating motion, i.e., an oscillating motion. An oscillating direction of the polishing head 90 is a direction perpendicular to the tangential direction of the wafer W. In this embodiment, an oscillation mechanism is constituted by the oscillation shaft 98, the pulleys p9 and p10, the belt b5, the motor M7, the oscillation-receiving block 97, and other elements.

The oscillation shaft 98 extends through a hollow tilt shaft 100, and is rotatably supported by bearings 101 and 102 secured to an inner surface of the tilt shaft 100. This tilt shaft 100 is rotatably supported by bearings 103 and 104. The tilt shaft 100 is coupled to a motor M8 via pulleys p11 and p12 and a belt b6. Therefore, the tilt shaft 100 is rotated by the motor M8 independently of the oscillation shaft 98.

A tilt plate 94 is fixed to the tilt shaft 100. Therefore, the rotation of the tilt shaft 100 causes the rotation of the oscillation plate 93 coupled to the tilt plate 94 via the linear guide 95, thus causing the rotation of the polishing head 90 fixed to the oscillation plate 93. The motor M8 is controlled so as to rotate through a predetermined angle in the clockwise direction and the counterclockwise direction. Therefore, as the motor M8 is energized, the polishing head 90 rotates about a contact portion between the polishing tape 75 and the wafer W through a predetermined angle (i.e., the polishing head 90 is tilted), as shown in FIG. 15. In this embodiment, a tilt mechanism is constituted by the pulleys p11 and p12, the belt b6, the motor M8, the tilt shaft 100, the tilt plate 94, and other elements.

The polishing head module 70A is installed on an X-axis moving mechanism and a Y-axis moving mechanism provided on the base plate 65. The X-axis moving mechanism includes X-axis rails 106 extending in a direction perpendicular to a line connecting the notch portion and the center of the wafer W on the holding stage 4, and X-axis guides 108 slidably attached to the X-axis rails 106. The Y-axis moving mechanism includes Y-axis rails 107 extending in a direction perpendicular to the X-axis rails 106, and Y-axis guides 109 slidably mounted on the Y-axis rails 107. The X-axis rails 106 are fixed to the base plate 65, and the X-axis guides 108 are coupled to the Y-axis rails 107 via a coupling plate 110. The Y-axis guides 109 is fixed to the polishing head module 70A. An X axis and a Y axis are virtual moving axes which cross at right angles in a horizontal plane.

The two polishing head modules 70A and 70B are arranged along the X axis and are parallel to each other. These polishing head modules 70A and 70B are coupled to an X-axis air cylinder (X-axis actuator) 113 via a single coupling shaft 111. The X-axis air cylinder 113 is fixed to the base plate 65. This X-axis air cylinder 113 is configured to move the two polishing head modules 70A and 70B synchronously in the X-axis direction. The polishing head modules 70A and 70B are coupled to Y-axis air cylinders (Y-axis actuators) 114, respectively, which are fixed to the coupling plate 110. These Y-axis air cylinders 114 are configured to move the two polishing head modules 70A and 70B independently of each other in the Y-axis direction.

With this arrangement, the two polishing head modules 70A and 70B can move on a plane parallel to the wafer W held by the rotary holding mechanism 3, and the polishing heads 90 of the polishing head modules 70A and 70B can move toward and away from the notch portion of the wafer W independently of each other. Because the polishing head modules 70A and 70B move synchronously in the X-axis direction, switching between the polishing head modules 70A and 70B can be performed in a reduced time. The tape supplying and recovering mechanism of this embodiment is different from that of the first embodiment in that the tape supplying and recovering mechanism constitutes part of the polishing head module and is configured to move together with the polishing head 90.

Next, operations of the polishing apparatus according to this embodiment will be described.

The wafer W is transferred by the transfer mechanism into the housing 71 through the transfer opening 71*a*. The holding stage 4 is elevated and the wafer W is held on the upper surface of the holding stage 4 by a vacuum suction. In this state, the notch searching unit 82 detects the position of the notch portion formed in the wafer W. The rotary holding mechanism 3 lowers the wafer W to the polishing position, while rotating the wafer W such that the notch portion faces the polishing head modules 70A and 70B. At the same time, the rinsing-liquid supply nozzle 83 starts supplying the rinsing liquid, or the chemical-liquid supply nozzle 84 starts supplying the chemical liquid.

Then, the polishing head module 70A moves toward the notch portion, and the polishing head 90 brings the polishing tape 75 into sliding contact with the notch portion to thereby polish the notch portion. More specifically, the polishing head 90 performs the oscillating motion so as to bring the polishing tape 75 into sliding contact with the notch portion. During polishing, the swinging mechanism causes the wafer W to perform the swinging motion, centered on the notch portion, in the horizontal plane, and the polishing head 90 performs the tilting motion centered on the notch portion.

After the polishing process by the polishing head module 70A is terminated, the polishing head module 70A moves away from the wafer W, and instead, the polishing head module 70B moves toward the notch portion of the wafer W. Then, the polishing head 90 performs the oscillating motion so as to bring the polishing tape 75 into sliding contact with the notch portion in the same manner to thereby polish the notch portion. During polishing, the swinging mechanism causes the wafer W to perform the swinging motion, centered on the notch portion, in the horizontal plane, and the polishing head 90 performs the tilting motion centered on the notch portion. After polishing, the supply of the ringing liquid or the chemical liquid is stopped. Then, the holding stage 4 is elevated and the wafer W is removed by the transfer mechanism and carried out through the transfer opening 71*a*.

The polishing tape used in the polishing head module 70A may be different from the polishing tape used in the polishing head module 70B. For example, the polishing head module 70A may use a polishing tape having rough abrasive grains so as to perform rough polishing, and the polishing head module 70B may use a polishing tape having fine abrasive grains so as to perform finish polishing after rough polishing. By using different types of polishing tapes, rough polishing and finish polishing can be performed while the wafer W is kept on the holding stage 4. Hence, the total polishing time can be shortened.

The tension of the polishing tape 75 (i.e., the polishing load) is kept constant by the motors M2 coupled to the supply reel 24 and the recovery reel 25. During polishing, the monitoring unit 92 monitors the output signal from the tension sensor 91 (i.e., the tension of he polishing tape 75), and determines whether the tension of the polishing tape 75 exceeds a predetermined threshold. A change in tension of the polishing tape 75 may be caused by deterioration of components with time. By monitoring the change in tension of the polishing tape 75, it is possible to determine the end of the service life of each component. In addition, because a maximum and a minimum of the polishing load can be found, it is also possible to detect a polishing failure caused by an excessively high load polishing.

It is also possible to detect the output signal of the tension sensor 91 by the monitoring unit 92 right before polishing and adjust an output torque of the motor M2, coupled to the supply reel 24, based on the output signal so as to exert a desired tension on the polishing tape 75.

The replacement operation of the polishing tape 75 can be easily conducted by moving one of the polishing head modules 70A and 70B toward the holding stage 4. For example, if the polishing tape 75 mounted on the polishing head module 70A is to be replaced, the polishing head module 70B is moved toward the holding stage 4, and in this state the polishing tape 75 on the polishing head module 70A is replaced. The replacement operation of the polishing tape 75 is conducted through the operation window 71*b* by an operator.

Figure 20:
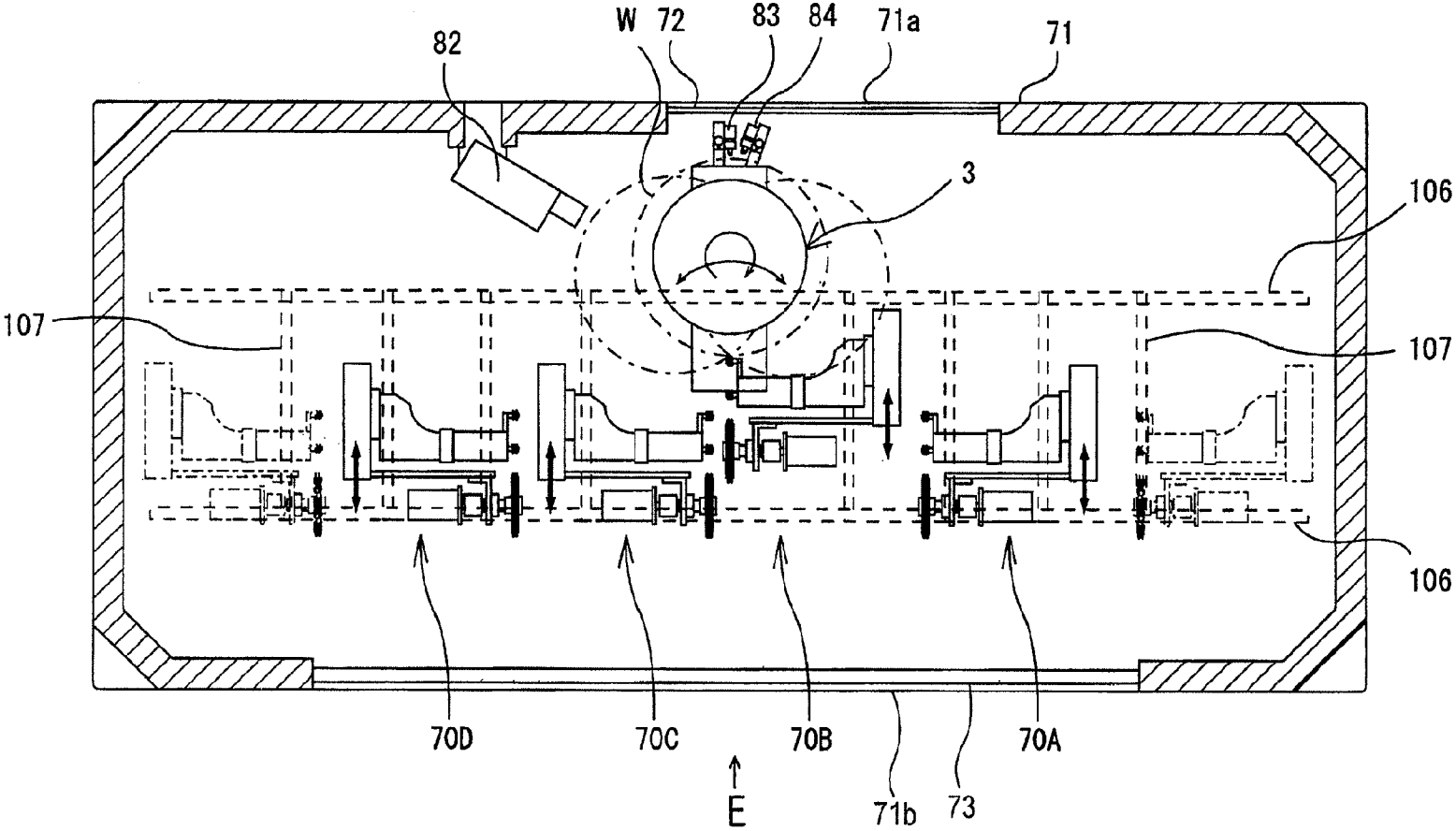
FIG. 20 is a plan view showing another example of the polishing apparatus according to the second embodiment of the present invention.
Figure 21:
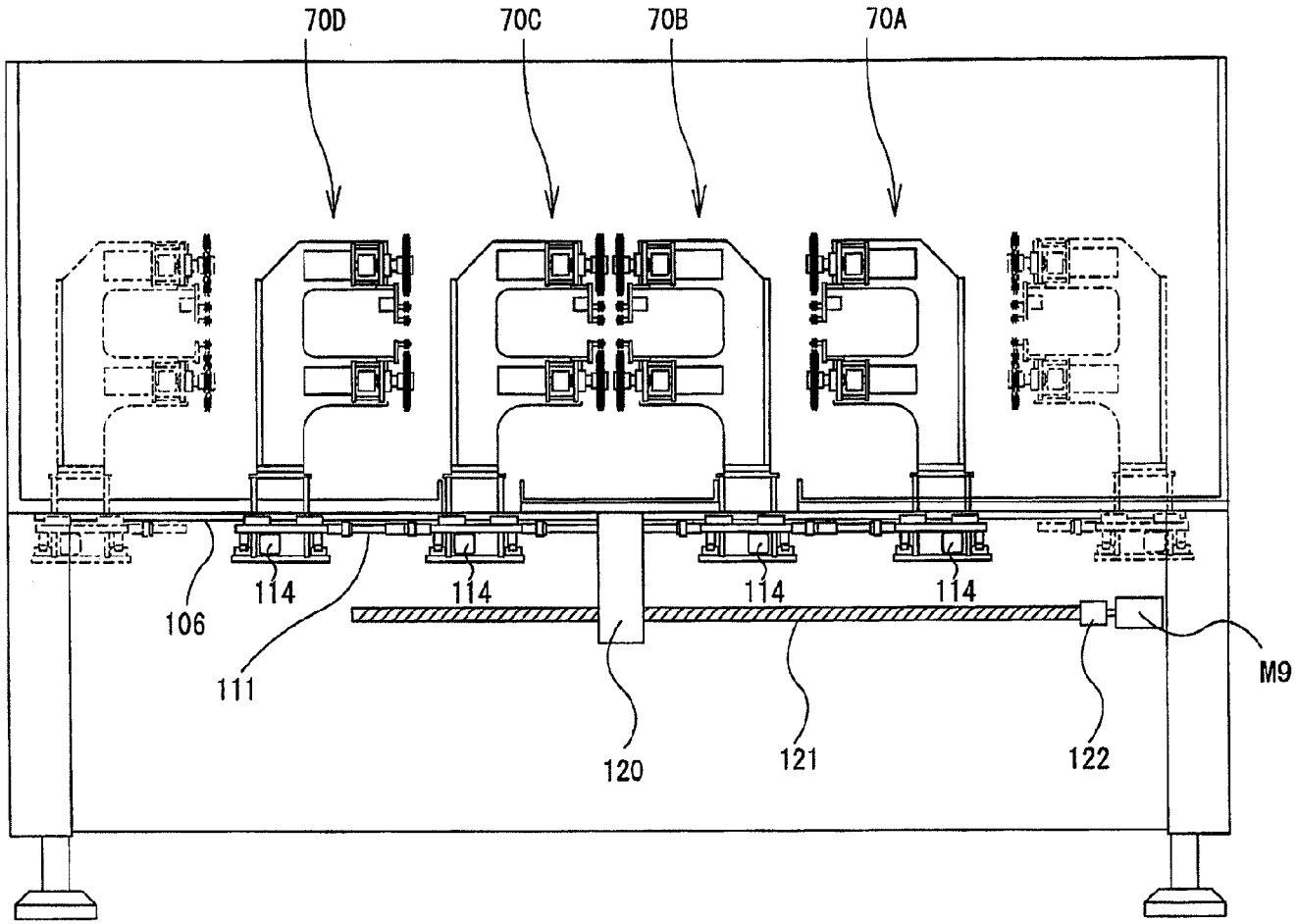
FIG. 21 is a side view of the polishing apparatus as viewed from a direction indicated by arrow E in FIG. 20.

FIG. 20 is a plan view showing another example of the polishing apparatus according to the second embodiment of the present invention. FIG. 21 is a side view of the polishing apparatus as viewed from a direction indicated by arrow E in FIG. 20. In this example, four polishing head modules 70A, 70B, 70C, and 70D are provided in a symmetric arrangement about the center of the wafer W. These four polishing head modules 70A, 70B, 70C, and 70D are coupled to each other via a single coupling shaft 111, so that all of the polishing head modules 70A, 70B, 70C, and 70D move synchronously in the X-axis direction.

A ball-screw support 120 is secured to the coupling shaft 111. A ball screw 121 is threaded through the ball-screw support 120. An end of the ball screw 121 is coupled to an X-axis drive motor M9 via a coupling 122. With this arrangement, the polishing head modules 70A, 70B, 70C, and 70D are moved synchronously in the X-axis direction by the X-axis drive motor M9. On the other hand, the four polishing head modules 70A, 70B, 70C, and 70D can be moved in the Y-axis direction independently of each other by Y-axis moving mechanisms each including the Y-axis rails 107, the Y-axis guides 109, and the Y-axis air cylinder 114.

Figure 22:
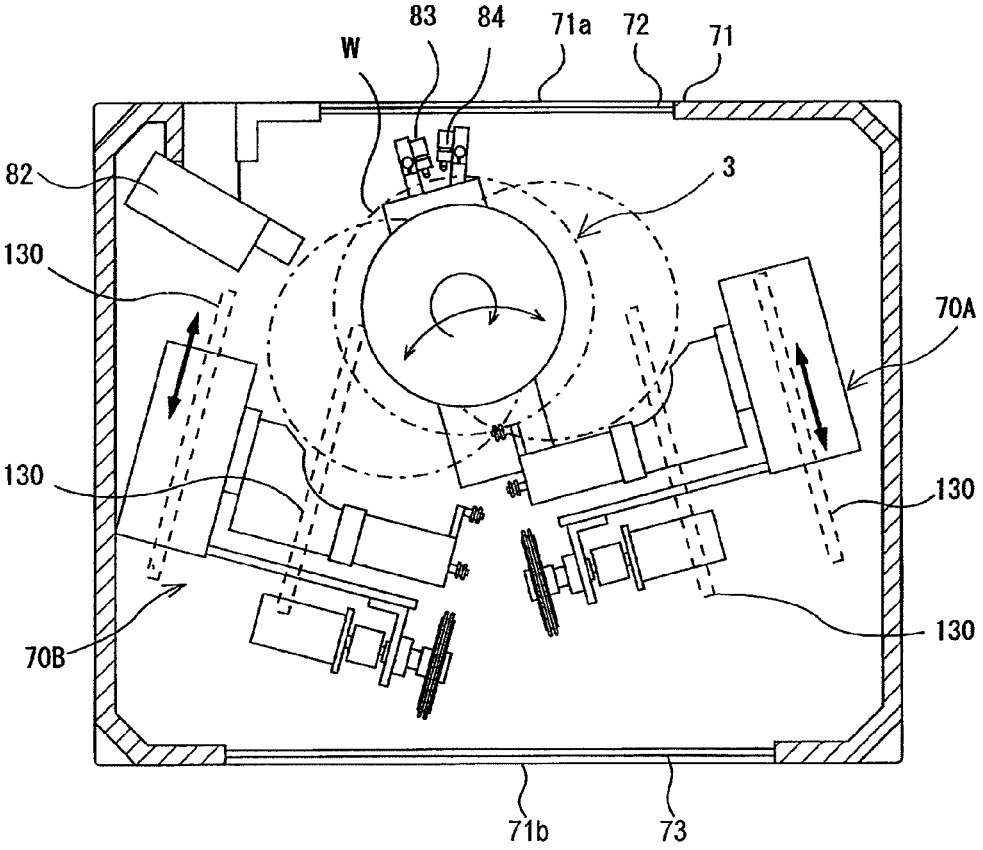
FIG. 22 is a plan view showing a polishing apparatus according to a third embodiment of the present invention.

FIG. 22 is a plan view showing a polishing apparatus according to a third embodiment of the present invention. Structures and operations of this embodiment, which will not be described below, are the same as those of the second embodiment described above.

As shown in FIG. 22, the polishing apparatus according to this embodiment does not have a mechanism corresponding to the X-axis moving mechanism (the X-axis rails 106, the X-axis guides 108, the X-axis air cylinder 113) of the second embodiment, but has linear moving mechanisms corresponding to the Y-axis moving mechanisms (the Y-axis rails 107, the Y-axis guides 109, the Y-axis air cylinder 114) of the second embodiment. Each of the linear moving mechanisms includes linear rails 130, linear guides, and a linear actuator, which are identical to the corresponding elements of the Y-axis moving mechanism according to the second embodiment.

Figure 23:
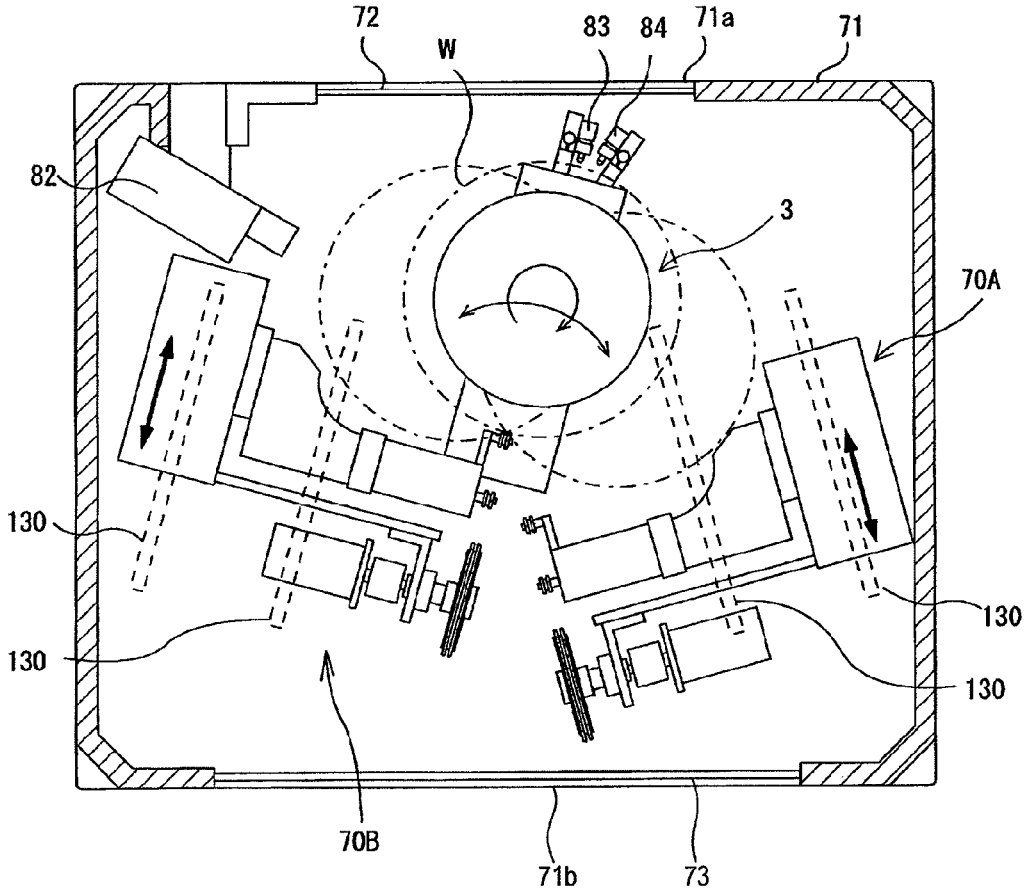
FIG. 23 is a plan view illustrating operations of the polishing apparatus according to the third embodiment of the present invention.

The two polishing head modules 70A and 70B are moved linearly by these linear moving mechanisms, respectively. Specifically, each of the polishing head modules 70A and 70B is moved along a single movement axis. The movement directions of the polishing head modules 70A and 70B are not parallel to each other. The polishing heads 90 of the two polishing head modules 70A and 70B are moved independently of each other by the linear moving mechanisms in directions toward and away from the notch portion of the wafer W on the holding stage 4 without contacting each other, as shown in FIGS. 22 and 23. Because the mechanism corresponding to the X-axis moving mechanism (the X-axis rails 106, the X-axis guides 108, the X-axis air cylinder 113) of the second embodiment is not required, the polishing apparatus can be provided at a reduced cost.

As shown in FIGS. 22 and 23, it is preferable to rotate the holding stage 4 before polishing such that the line connecting the notch portion and the center of the wafer W is aligned with the movement direction of the polishing head module 70A or 70B (i.e., such that the notch portion faces the polishing surface of the polishing tape 75). In this case, this position of the holding stage 4 is the center of the swinging motion of the wafer W.

Figure 24:
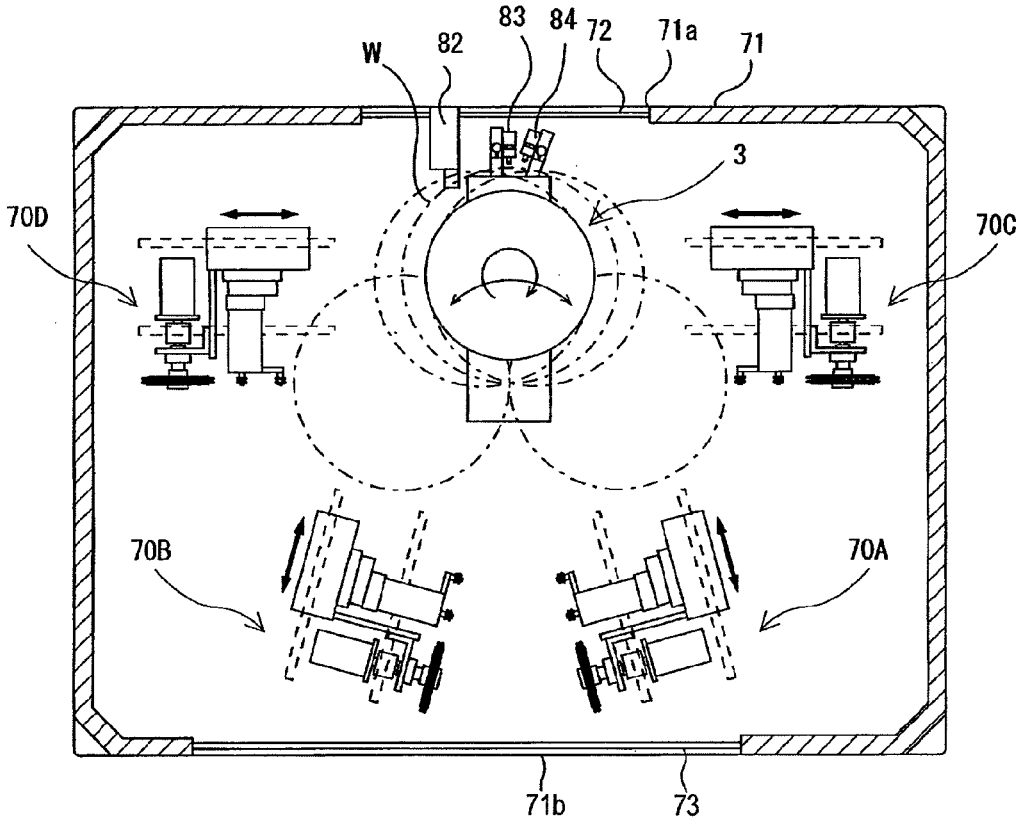
FIG. 24 is a plan view showing another example of the polishing apparatus according to the third embodiment of the present invention.

FIG. 24 is a plan view showing another example of the polishing apparatus according to the third embodiment of the present invention. As shown in FIG. 24, in this example, two polishing head modules 70C and 70D are provided in addition to the two polishing head modules 70A and 70B in FIG. 22. These polishing head modules 70C and 70D have the same structure as the polishing head modules 70A and 70B. The polishing head modules 70A and 70B are movable by the linear moving mechanisms in the directions toward and away from the notch portion of the wafer W, as indicated by arrows.

Figure 25:
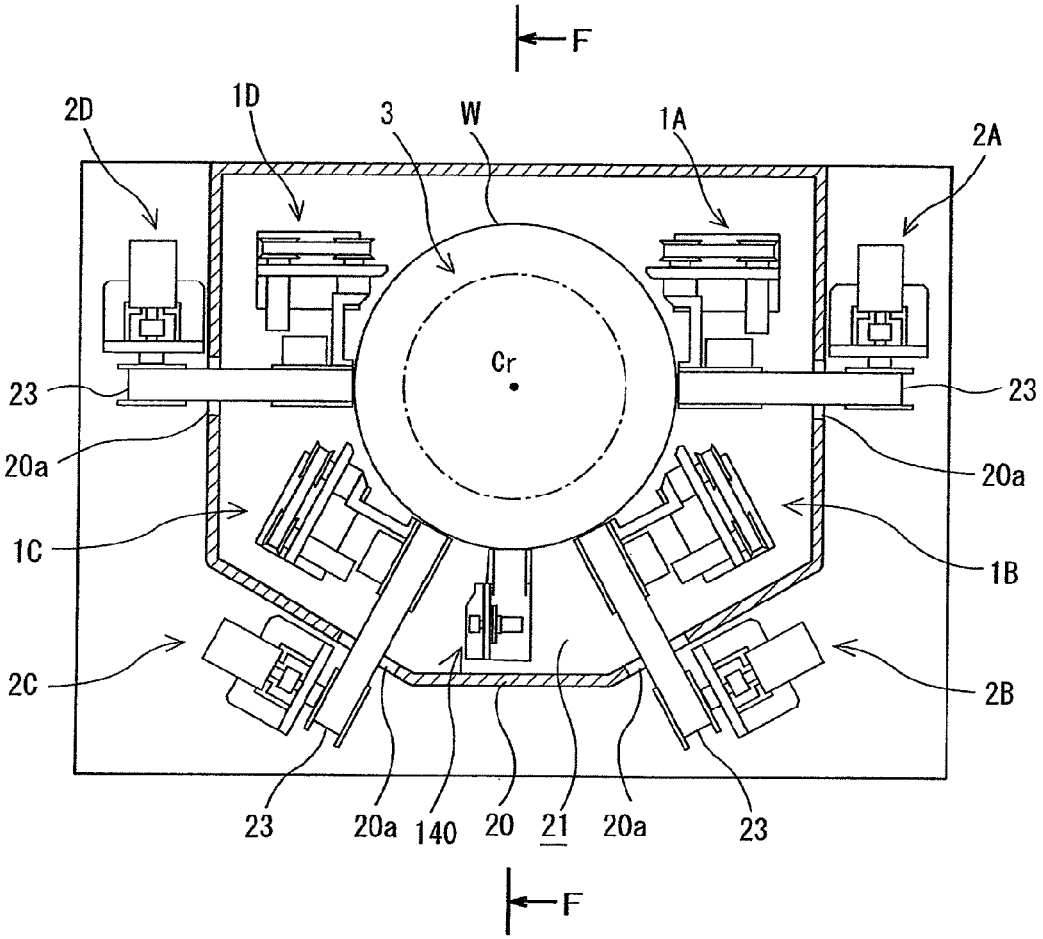
FIG. 25 is a plan view showing a polishing apparatus according to a fourth embodiment of the present invention.
Figure 26:
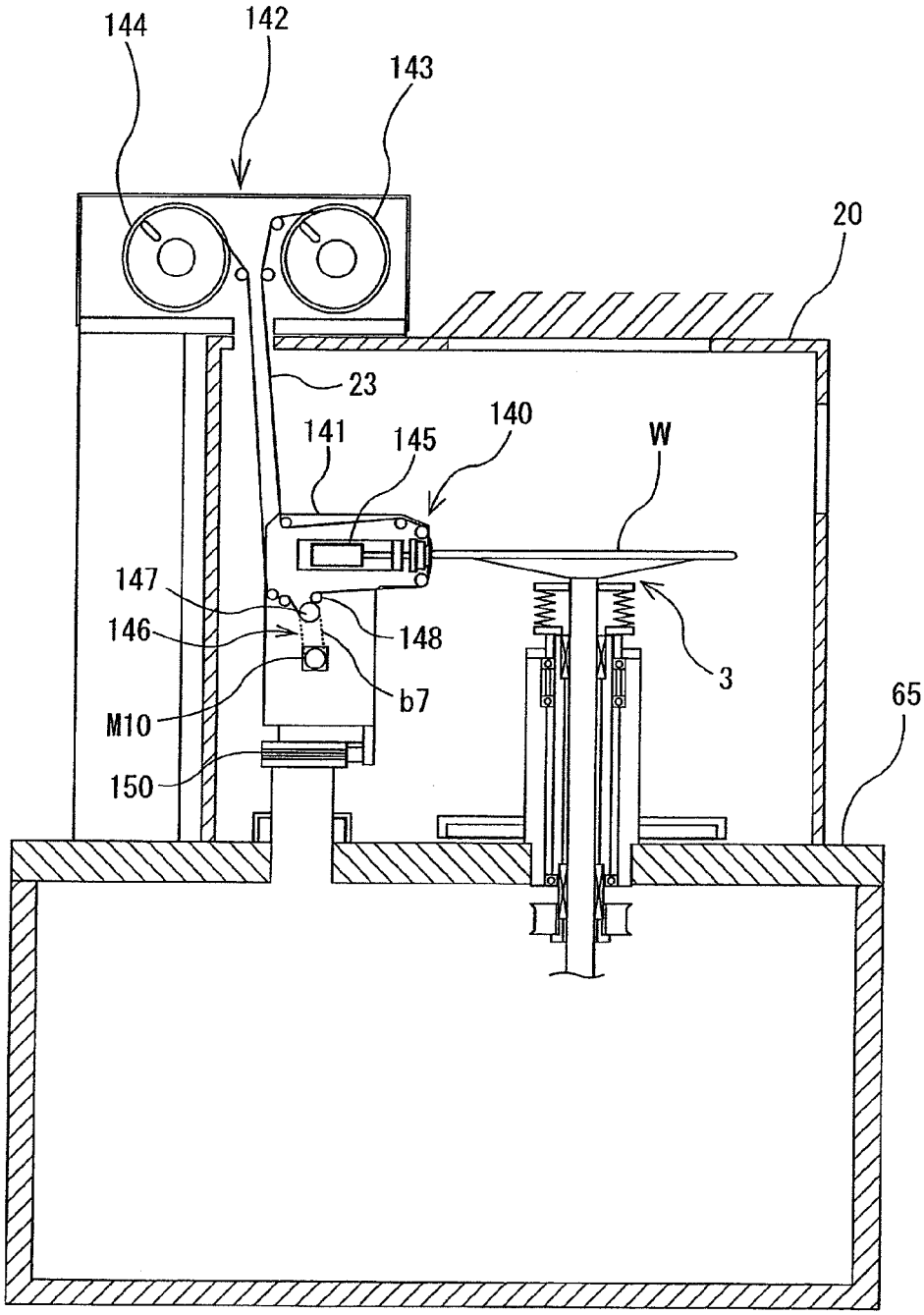
FIG. 26 is a cross-sectional view taken along line F-F in FIG. 25.

FIG. 25 is a plan view showing a polishing apparatus according to a fourth embodiment of the present invention, and FIG. 26 is a cross-sectional view taken along line F-F in FIG. 25. The polishing apparatus according to the fourth embodiment is suitable for use in polishing of the bevel portion of the substrate. As shown in FIG. 25, the polishing apparatus according to this embodiment has five polishing head assemblies 1A, 1B, 1C, 1D, and 140. More specifically, this polishing apparatus has a structure in which the polishing head assembly 140 is added to the polishing apparatus according to the first embodiment. The polishing head assembly 140 is located between the polishing head assemblies 1B and 1C. This polishing head assembly 140 has a polishing head 141 with a fixed angle of inclination, as shown in FIG. 26. The fixed angle of inclination means that an angle of inclination of the polishing head 141 cannot be changed during polishing. However, it is possible to change an installation angle of the polishing head 141 so as to adjust a contact angle of the polishing head 141 with respect to the wafer W. In this example, the polishing head 141 is installed in such an angle that the polishing surface of the polishing tape 23 contacting the wafer W is perpendicular to the surface of the wafer W.

A tape supplying and recovering mechanism 142 has the same structure as the supplying and recovering mechanisms 2A, 2B, 2C, and 2D, but is located above the polishing head 141, as shown in FIG. 26. More specifically, this tape supplying and recovering mechanism 142 is mounted on the upper surface of the partition wall 20. The tape supplying and recovering mechanism 142 includes a supply reel 143 for supplying the polishing tape 23 to the polishing head 141 and a recovery reel 144 for recovering the polishing tape 23 from the polishing head 141. Since the tape supplying and recovering mechanism 142 is located in this position, it does not obstruct the maintenance operations for the polishing head assemblies 1A, 1B, 1C, and 1D. As shown in FIG. 26, the polishing head 141 has a pressing mechanism 145 configured to press the polishing tape 23 against the bevel portion of the wafer W, and a tape-sending mechanism 146 configured to send the polishing tape 23. The pressing mechanism 145 is identical to the pressing mechanism 41 according to the first embodiment (see FIG. 5).

The tape-sending mechanism 146 has a tape-sending roller 147, a tape-holding roller 148, and a motor M10 configured to rotate the tape-sending roller 147. The tape-sending roller 147 and the motor M10 are spaced from each other, and are coupled to each other via a belt b7. Specifically, the tape-sending roller 147 is rotated by the motor M10 via the belt b5 to thereby cause the polishing tape 23 to move in its longitudinal direction. A linear actuator 150 is coupled to a lower portion of the polishing head 141. This linear actuator 150 is operable to move the polishing head 141 toward and away from the wafer W. An air cylinder or a combination of a positioning motor and a ball screw can be used as the linear actuator 150.

The arrangement and combination of the polishing head assemblies 1A, 1B, 1C, and 1D each having the polishing head with a variable angle of inclination (hereinafter, they will be referred to as variable-angle polishing head assemblies) and the polishing head assembly 140 having the polishing head with the fixed angle of inclination (hereinafter, this will be referred to as a fixed-angle polishing head assembly) are not limited to the example shown in FIG. 25. However, it is preferable to incorporate at least one fixed-angle polishing head assembly in a case of installing five or more polishing head assemblies. This is because the fixed-angle polishing head assembly is more compact than the variable-angle polishing head assemblies. Therefore, by adding the fixed-angle polishing head assembly (assemblies), it is possible to install six or seven polishing head assemblies in total.

Figure 27:
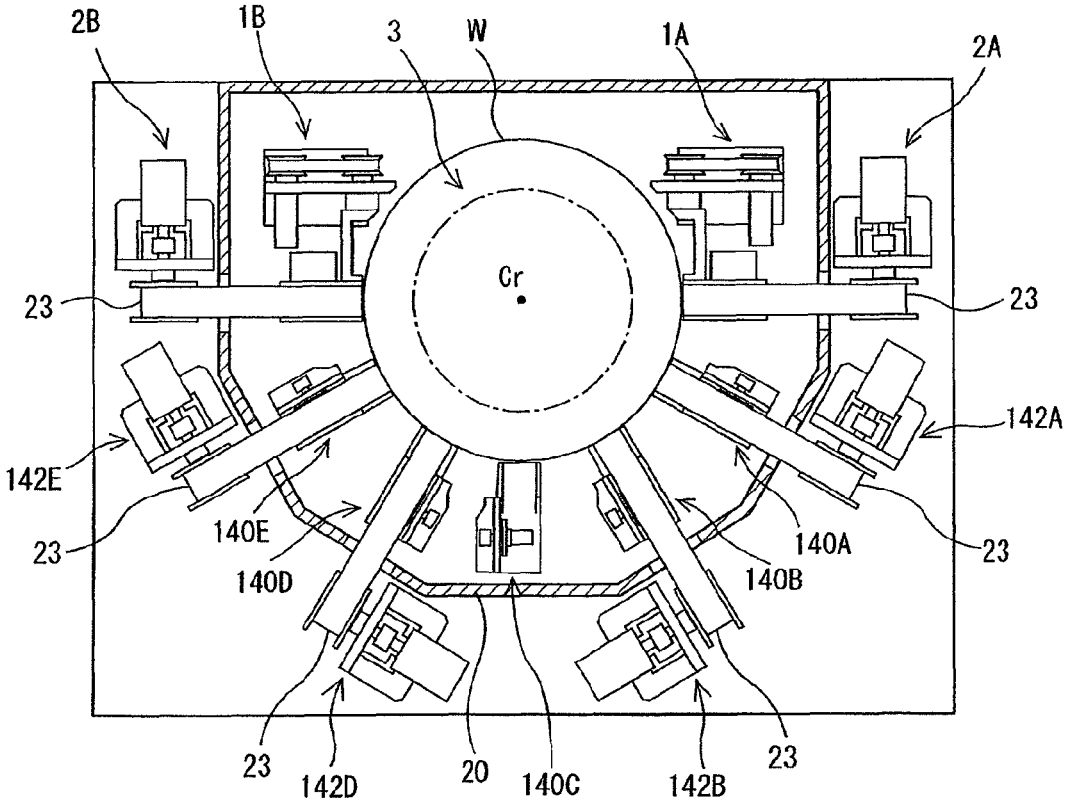
FIG. 27 is a plan view showing an example of a polishing apparatus having seven polishing head assembles installed therein.

FIG. 27 is a plan view showing an example of a polishing apparatus having seven polishing head assembles installed therein. In this example, two variable-angle polishing head assemblies 1A and 1B and five fixed-angle polishing head assemblies 140A, 140B, 140C, 140D, and 140E are installed. These fixed-angle polishing head assemblies 140A, 140B, 140C, and 140D have the same structure as the polishing head assembly 140 shown in FIG. 25.

A tape supplying and recovering mechanism for supplying the polishing tape 23 to the fixed-angle polishing head assembly 140C and recovering the polishing tape 23 from the fixed-angle polishing head assembly 140C has the same structure as the tape supplying and recovering mechanism 142 shown in FIG. 26 and is disposed in the same location. Tape supplying and recovering mechanisms 142A, 142B, 142D, and 142E are arranged outwardly of the five fixed-angle polishing head assemblies 140A, 140B, 140D, and 140E with respect to the radial direction of the wafer W. These tape supplying and recovering mechanisms 142A, 142B, 142D, and 142E are located outside of the polishing room 21, and have the same structure as the above-described tape supplying and recovering mechanisms 2A, 2B, 2C, and 2D.

By using the increased number of polishing heads, the polishing time can be shortened and the throughput can be improved. One example of the installation angle of the polishing head 141 in each fixed-angle polishing head assembly is an angle corresponding to a portion that requires a relatively long polishing time. The angles of the polishing heads 141 in the fixed-angle polishing head assemblies 140A, 140B, 140C, 140D, and 140E may be different from each other or may be the same as each other. Because the fixed-angle polishing head assemblies 140A, 140B, 140C, 140D, and 140E do not require tilt motors for tilting the polishing heads 141 (see FIG. 26), these assemblies can be more compact and can be provided at a lower cost than the variable-angle polishing head assemblies. Further, since the moving mechanism (i.e., the linear actuator 150, see FIG. 26) for moving the polishing head 141 back and forth can be compact, this moving mechanism can be installed in the polishing room 21. Further, more various kinds of polishing tapes 23 can be used and therefore the wafer W can be polished under polishing conditions more suitable for the wafer W.

Figure 28:
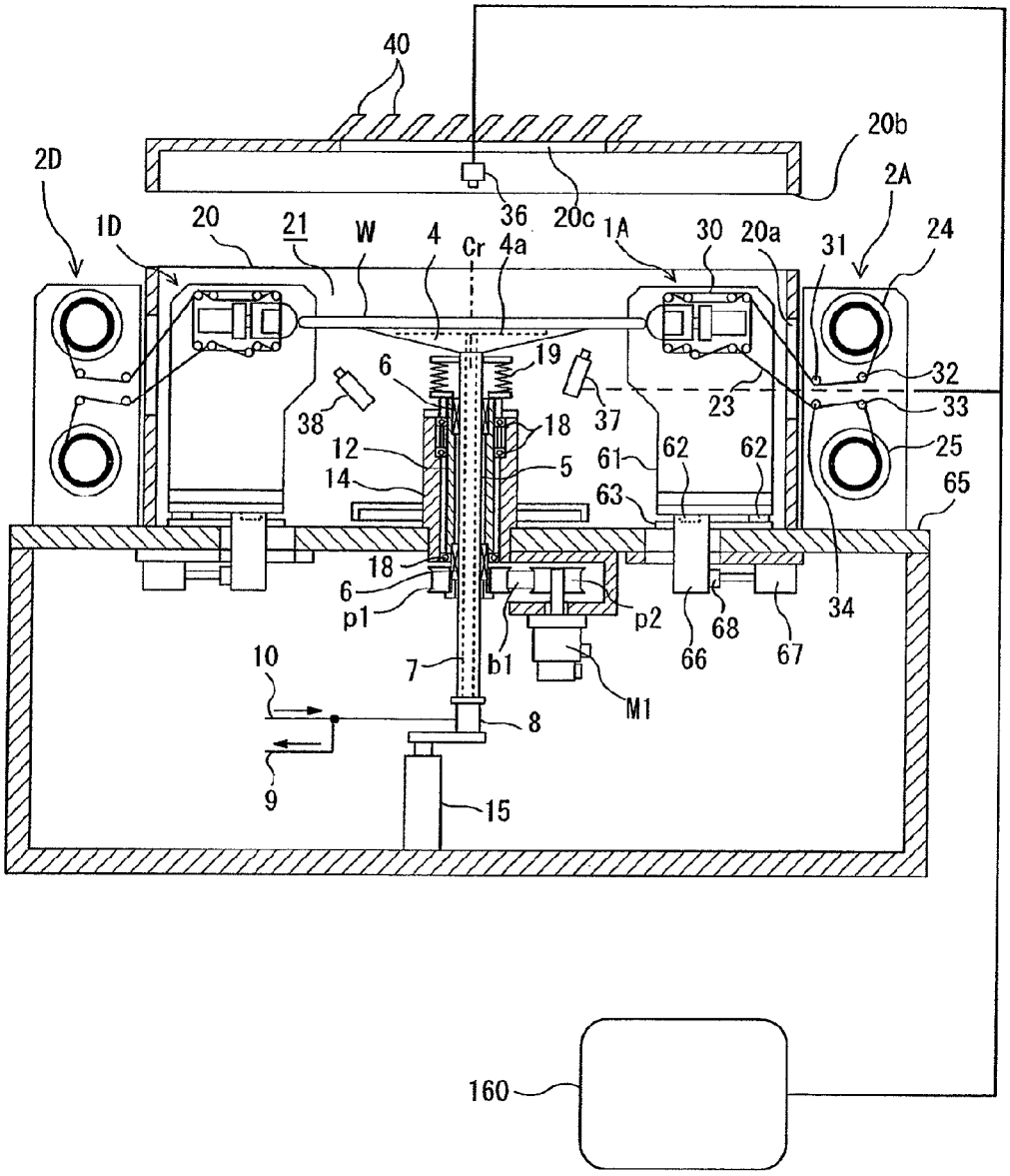
FIG. 28 is a vertical cross-sectional view showing a polishing apparatus according to a fifth embodiment of the present invention.

FIG. 28 is a vertical cross-sectional view showing a polishing apparatus according to a fifth embodiment of the present invention. The polishing apparatus according to this embodiment includes a cooling-liquid supply unit 160 for supplying a cooling liquid to the upper supply nozzle 36 and the lower supply nozzle 37. Other structures and operations of this embodiment are identical to those of the first embodiment and will not be described repetitively. The cooling-liquid supply unit 160 has basically the same components as a known cooling-liquid supply apparatus, but is different in that a liquid contact portion thereof is made of a material (e.g., Teflon) which does not contaminate the wafer W. The cooling-liquid supply unit 160 is capable of cooling the cooling liquid to about 4° C. The cooling liquid, cooled by the cooling-liquid supply unit 160, is supplied from the upper supply nozzle 36 and the lower supply nozzle 37 to the polishing tape 23 via the wafer W. Pure water or ultrapure water is suitable for use as the cooling liquid.

The purpose of supplying the cooling liquid during polishing is to remove heat generated by friction between the wafer W and the polishing tape 23. Typically, the polishing tape 23 comprises abrasive grains (e.g., diamond, silica, or ceria), a resin (a binder) for binding the abrasive grains, and a tape base such as a PET sheet. The production process of the polishing tape 23 is generally as follows. The abrasive grains are dispersed in a melted resin, and a surface of the tape base is coated with the resin containing the abrasive grains. Then, the resin is dried to thereby form the polishing surface. If the resin softens with heat generated during polishing, the polishing performance is lowered. This seems to be due to the fact that a force of the resin for binding the abrasive grains is lowered. Further, if the resin softens, the abrasive grains could be detached from the resin.

Thus, in this embodiment, the cooling liquid is supplied to a contact portion between the polishing tape 23 and the wafer W during polishing so as to cool the polishing tape 23. More specifically, the cooling liquid is supplied onto the wafer W being rotated by the rotary holding mechanism 3, and is moved on the surface of the wafer W by a centrifugal force to contact the polishing tape 23. The cooling liquid removes heat, generated during polishing, from the polishing tape 23. As a result, the polishing performance of the polishing tape 23 can be maintained, and the polishing speed (removal rate) is prevented from being lowered.

Next, results of several experiments conducted using the cooling liquid for cooling the polishing tape will be described. In a first experiment, ultrapure water having an ordinary temperature (18° C.) was used as the cooling liquid. Polishing of a wafer was performed several times using one polishing head assembly, two polishing head assemblies, three polishing head assemblies, and four polishing head assemblies, separately. The results showed that the polishing performance was hardly lowered in the polishing processes using one polishing head assembly and two polishing head assemblies. On the other hand, in the polishing process using three polishing head assemblies, the polishing performance was lowered. In the polishing process using four polishing head assemblies, the polishing performance was remarkably lowered.

In the second experiment, polishing was conducted while cooling the polishing tape with ultrapure water (i.e., the cooling liquid) having a temperature of 10° C. The specific manner of polishing was the same as that in the above-described experiment. The experiment results showed that the polishing tape exhibited its original polishing performance in both polishing processes using three polishing head assemblies and four polishing head assemblies. Specifically, in the polishing process using three polishing head assemblies, the polishing performance was three times the polishing performance in the case of using one polishing head assembly. In the polishing process using four polishing head assemblies, the polishing performance was four times the polishing performance in the case of using one polishing head assembly.

Further, using one polishing head assembly, polishing was conducted while gradually decreasing the temperature of the ultrapure water from the ordinary temperature. The results of this experiment showed that use of the ultrapure water with a lower temperature resulted in a higher removal rate and a smaller variation in removal rate.

In addition to the above-mentioned experiments, polishing was conducted under various polishing conditions. The results showed that a relationship between the temperature of the cooling liquid and the removal rate depends on a physical property of the polishing tape, a rotational speed of the wafer (i.e., a relative speed between the polishing tape and the wafer), and the size of the abrasive grains of the polishing tape. In particular, the effect of the cooling liquid was remarkable when using a polishing tape having abrasive grains (e.g., silica particles or diamond particles) that exhibit a large mechanical polishing action, when using a polishing tape having small-sized abrasive grains (i.e., fine abrasive grains), and when the relative speed between the wafer and the polishing tape was high.

From the above experimental results, it can be seen that use of the cooling liquid having a temperature of at most 10° C. can prevent a decrease in removal rate and can stabilize the removal rate. Moreover, the experimental results further showed that a gradient of these effects was small when using the cooling liquid having a temperature of at most 10° C. Therefore, it is preferable to supply the cooling liquid having a temperature of at most 10° C. to the polishing tape during polishing. It is preferable that the cooling-liquid supply unit 160 be configured to selectively supply a low-temperature cooling liquid or an ordinary-temperature cooling liquid to the upper supply nozzle 36 and the lower supply nozzle 37. For example, the low-temperature cooling liquid may be supplied to the wafer during polishing, and the ordinary-temperature cooling liquid may be supplied to the wafer during cleaning of the wafer after polishing.

Figure 29:
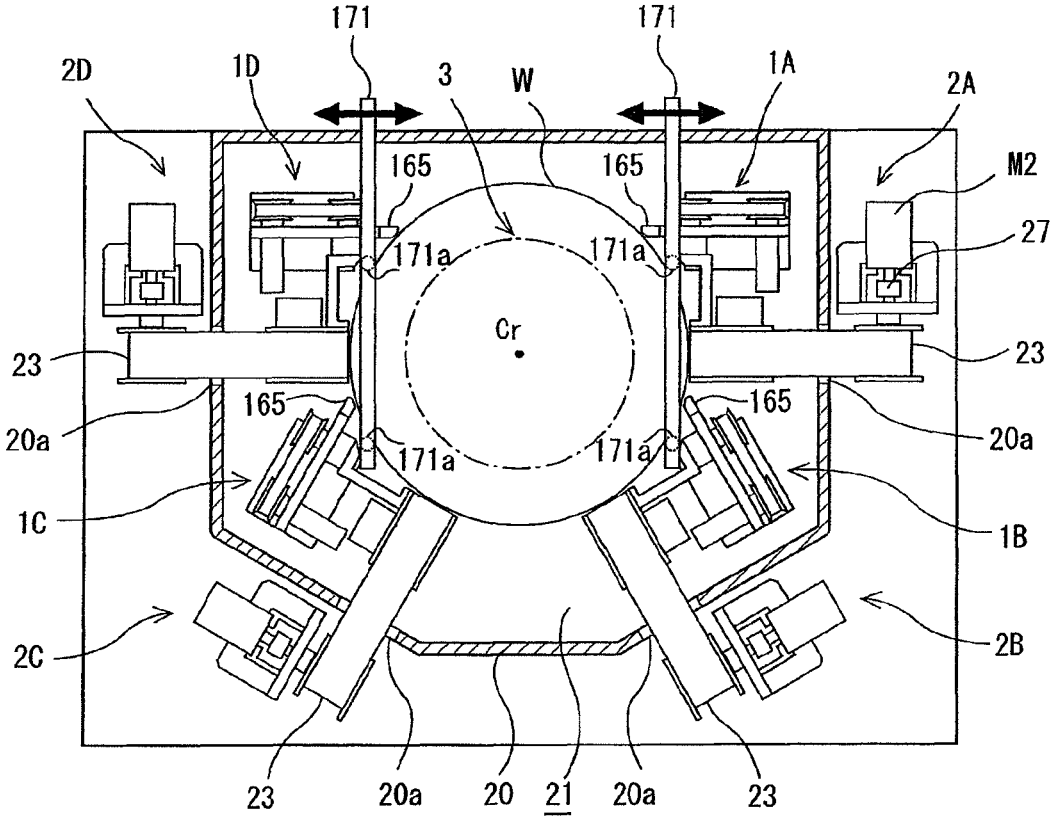
FIG. 29 is a plan view showing a polishing apparatus according to a sixth embodiment of the present invention.
Figure 30:
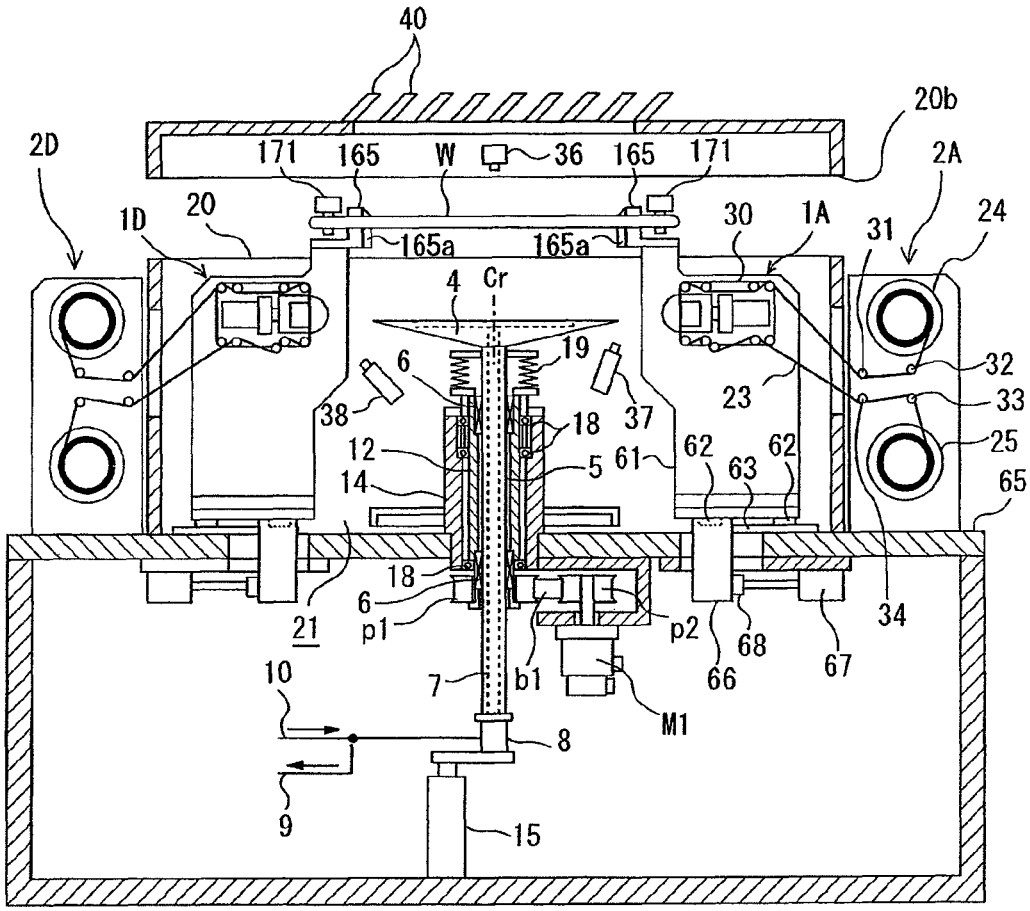
FIG. 30 is a vertical cross-sectional view of the polishing apparatus shown in FIG. 29.

FIG. 29 is a plan view showing a polishing apparatus according to a sixth embodiment of the present invention, and FIG. 30 is a vertical cross-sectional view of the polishing apparatus shown in FIG. 29. Structures and operations of this embodiment, which will not be described, are identical to those of the first embodiment and will not be described repetitively.

As shown in FIGS. 29 and 30, plural (four in this embodiment) centering guides 165 are coupled to the linear actuators (moving mechanisms) 67 via the polishing head assemblies 1A, 1B, 1C, and 1D. More specifically, the centering guides 165 are provided on upper portions of the respective movable bases 61 of the polishing head assemblies 1A, 1B, 1C, and 1D, so that the centering guides 165 are moved by the linear actuators 67 together with the polishing head assemblies 1A, 1B, 1C, and 1D. Thus, the centering guides 165 are moved by the linear actuators 67 in directions toward and away from the periphery of the wafer W. The centering guides 165 have guide surfaces 165*a*, respectively, extending vertically. These guide surfaces 165*a* are located at the transfer position of the wafer and face the rotational axis of the rotary holding mechanism 3.

The wafer W is transferred into the polishing room 21 by a pair of hands 171 of the transfer mechanism, with the periphery of the wafer W being grasped by plural claws 171*a* of the hands 171. In this state, the hands 171 are lowered slightly, and then the centering guides 165 move toward the wafer W. The centering guides 165 move until the guide surfaces 165*a* thereof contact the outermost edge surface of the wafer W, so that the wafer W is held by the centering guides 165. The center of the wafer W in this state lies on the rotational axis of the rotary holding mechanism 3. Then, the hands 171 move away from the wafer W. Subsequently, the holding stage 4 of the rotary holding mechanism 3 is elevated so as to hold the rear surface of the wafer W by the vacuum attraction. Then, the centering guides 165 move away from the wafer W, and the holding stage 4 is lowered to the polishing position together with the wafer W.

Because the centering guides 165 are incorporated in the polishing apparatus, centering of the wafer W is performed in the same structural unit as the rotary holding mechanism 3. Therefore, an accuracy of centering can be improved. Since the centering guides 165 are coupled to the linear actuators 67 for moving the polishing head assemblies 1A, 1B, 1C, and 1D, it is not necessary to provide moving mechanisms dedicated to moving the centering guides 165. However, the present invention is not limited to this embodiment. In order to perform the centering of the wafer W, at least three centering guides are required. In a case where only two polishing head assemblies are provided, centering of the wafer cannot be performed with the structures in this embodiment. Thus, a moving mechanism dedicated to the centering guide 165 may be provided so as to move the centering guide 165 independently of the polishing head assemblies.

The hands 171 of the transfer mechanism are not limited to the example as shown in FIGS. 29 and 30, and any type of hands can be used as long as they can transfer and receive the wafer W to and from the centering guides 165.

Figure 31:
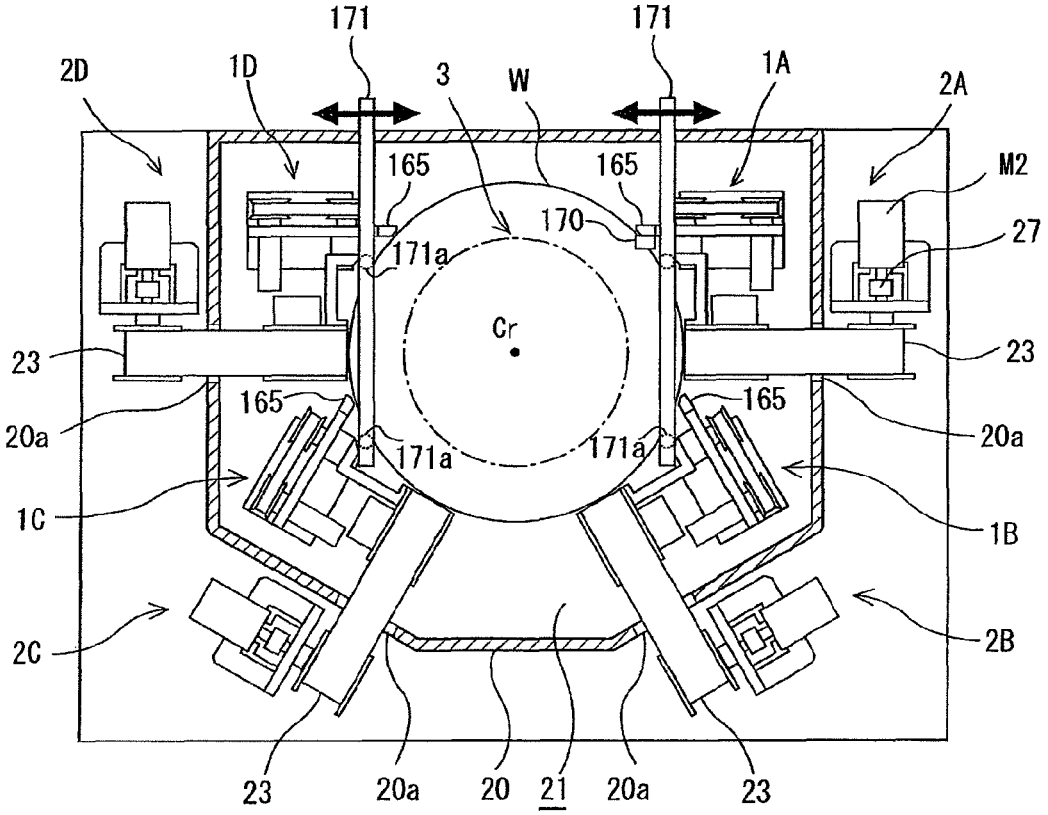
FIG. 31 is a plan view showing a modification of the polishing apparatus according to the sixth embodiment of the present invention.
Figure 32:
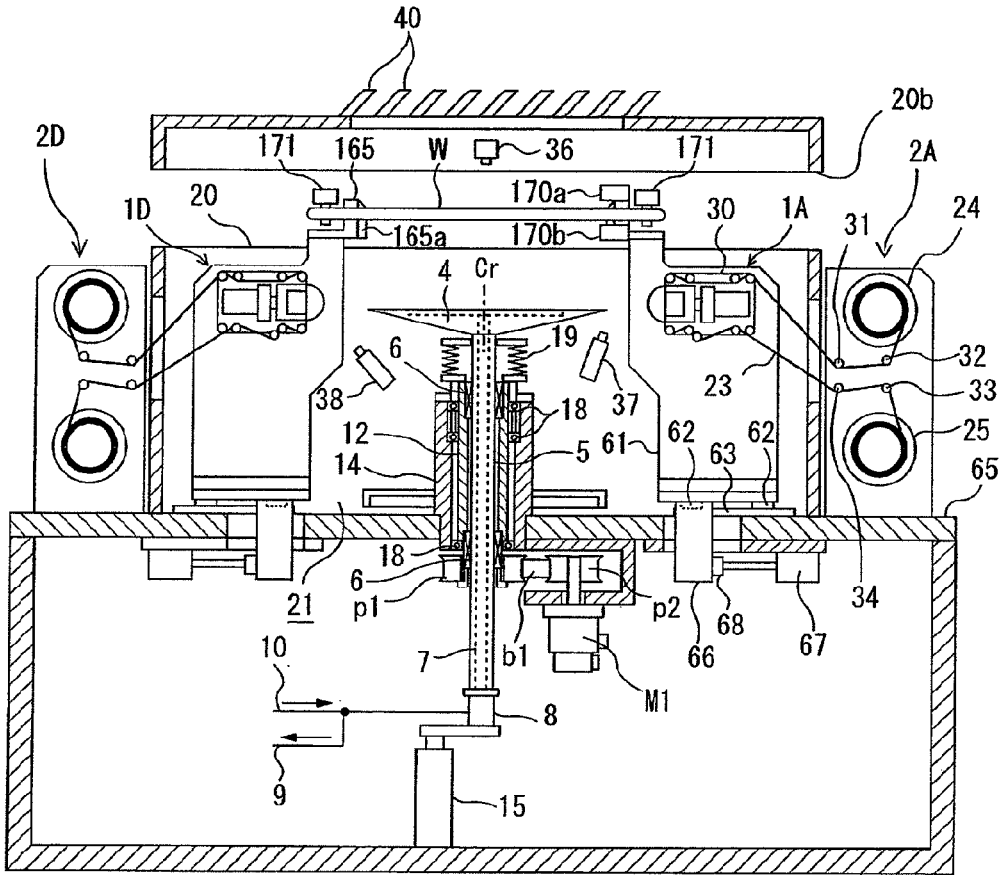
FIG. 32 is a vertical cross-sectional view of the polishing apparatus shown in FIG. 31.

FIG. 31 is a plan view showing a modification of the polishing apparatus according to the sixth embodiment of the present invention, and FIG. 32 is a vertical cross-sectional view of the polishing apparatus shown in FIG. 31. The polishing apparatus in this example has an eccentricity detector 170 configured to detect an eccentricity of the wafer W held by the rotary holding mechanism 3. This eccentricity detector 170 is attached to one of the centering guides 165. The eccentricity detector 170 includes a light-emitting section 170*a* and a light-receiving section 170*b* which are arranged such that the wafer W is interposed therebetween. The light-emitting section 170*a* is configured to emit a wide light in the shape of strip, and the light-receiving section 170*b* is configured to receive the light. A laser or LED can be used as a light source of the light-emitting section 170*a*. When the periphery of the wafer W lies between the light-emitting section 170*a* and the light-receiving section 170*b*, part of the light is blocked by the wafer W. The light-receiving section 170*b* is configured to measure a length of the part of the light blocked by the wafer W. Generally, the eccentricity detector 170 of this type is called a transmission-type sensor. A reflection-type sensor, which has a light-emitting section and a light-receiving section facing in the same direction, may be used as the eccentricity detector 170.

The eccentricity detector 170 detects the eccentricity of the wafer W as follows. After the wafer W is held by the rotary holding mechanism 3, the centering guides 165 are moved slightly away from the wafer W. Then, the rotary holding mechanism 3 rotates the wafer W. In this state, the light-emitting section 170*a* emits the light toward the light-receiving section 170*b*, and the light-receiving section 170*b* receives the light. If the length of the part of the light blocked by the periphery of the wafer W is constant, it indicates that the center of the wafer W is on the rotational axis of the rotary holding mechanism 3. On the other hand, if the length of the part of the light blocked by the periphery of the wafer W fluctuates, it indicates that the center of the wafer W is not on the rotational axis of the rotary holding mechanism 3, i.e., the wafer W is in an eccentric position.

If the eccentricity of the wafer W is beyond a predetermined threshold, the polishing apparatus generates an alarm so as to urge that centering of the wafer W should be performed again or the positions of the centering guides 165 should be adjusted. With the operations as described above, the wafer W can be polished precisely. Moreover, damage to the wafer W during polishing due to the eccentricity thereof can be prevented.

The eccentricity detector 170 according to this embodiment can also be used to detect the notch portion or an orientation flat formed in the periphery of the wafer W. When detecting the eccentricity of the wafer W, the eccentricity detector 170 excludes a notch portion and the orientation flat from the periphery of the wafer W in order to measure the length of the part of the light blocked by the wafer W. It is preferable to detect the notch portion or the orientation flat before transferring the wafer W and to slightly rotate the wafer W such that the detected notch portion or the orientation flat does not face the hands of the transfer mechanism. With this operation, a transferring error, that could be caused by holding of the notch portion or the orientation flat by the hands of the transfer mechanism, can be prevented.

Figure 33:
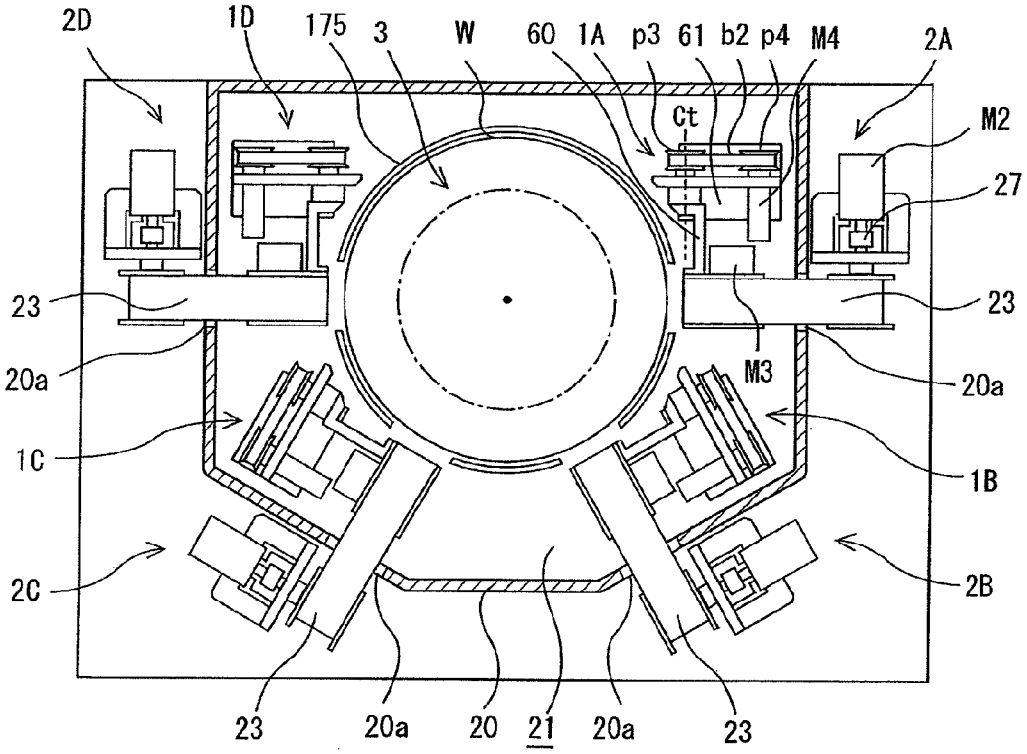
FIG. 33 is a plan view showing a polishing apparatus according to a seventh embodiment of the present invention.
Figure 34:
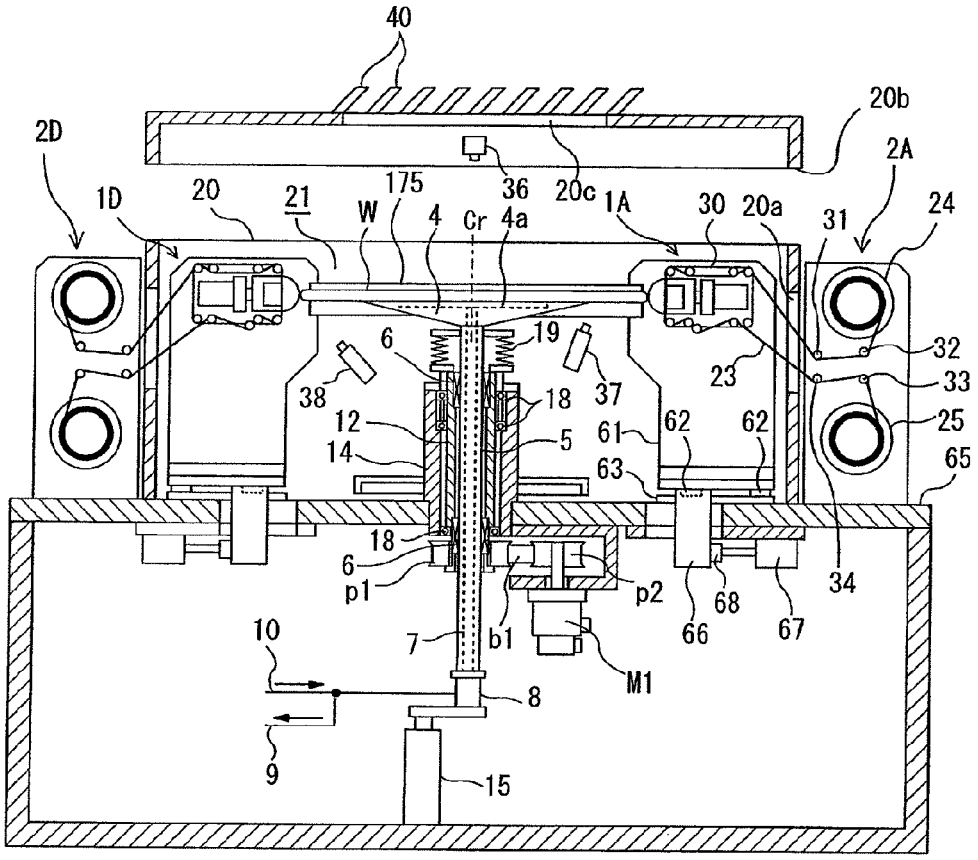
FIG. 34 is a vertical cross-sectional view showing the polishing apparatus according to the seventh embodiment of the present invention.

FIG. 33 is a plan view showing a polishing apparatus according to a seventh embodiment of the present invention, and FIG. 34 is a vertical cross-sectional view showing the polishing apparatus according to the seventh embodiment of the present invention. Structures and operations of this embodiment, which will not be described, are identical to those of the first embodiment and will not be described repetitively.

As shown in FIGS. 33 and 34, a cylindrical shroud cover 175 is provided so as to surround the wafer W held by the rotary holding mechanism 3. This shroud cover 175 is supported by non-illustrated columns that are secured to the casing 14 of the rotary holding mechanism 3. The shroud cover 175 is fixed in position and is not elevated together with the wafer W.

The shroud cover 175 has openings (or gaps) in positions corresponding to the polishing heads 30 of the polishing head assemblies 1A, 1B, 1C, and 1D, so that the polishing heads 30 can access the wafer W through these openings. The shroud cover 175 is located close to the periphery of the wafer W, and a gap between the shroud cover 175 and the wafer W is several millimeters.

The shroud cover 175 has an upper edge in a position higher than the surface of the wafer W in the polishing position by about 10 mm. The purpose of providing this shroud cover 175 is to prevent the polishing liquid (typically pure water), supplied onto the upper surface and the lower surface of the rotating wafer W during polishing, from scattering and further to prevent the polishing liquid from bouncing back to the wafer W.

Figure 35A:
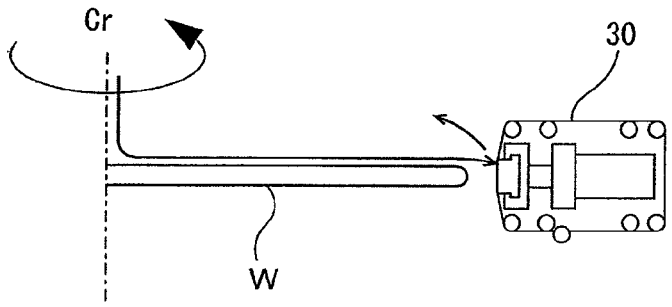
FIG. 35A is a side view showing a state in which polishing liquid bounces back to a wafer.

However, the polishing liquid could impinge upon the polishing head 30 that is not in the polishing operation and could bounce back to the wafer W, as shown in FIG. 35A. The polishing liquid, that has bounced back to the wafer W, contains the abrasive grains and the polishing debris, which can contaminate the wafer W. Thus, in this embodiment, in order to prevent the polishing liquid from bouncing back, a distance of the polishing head 30 from the wafer W or the angle of the inclination of the polishing head 30 is adjusted. The distance and the angle of inclination of the polishing head 30 are controlled by the operation controller 69 (see FIG. 1).

Figure 35B:
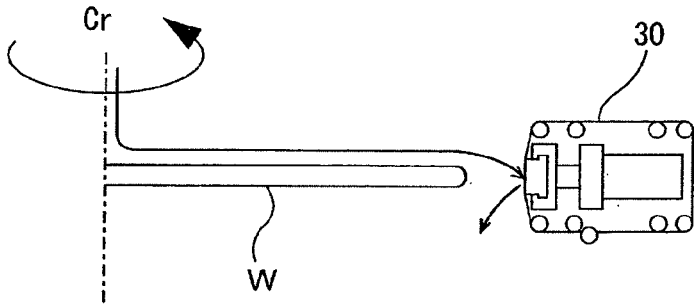
FIG. 35B is a side view showing a state in which a polishing head is positioned away from the wafer so as to prevent the polishing liquid from bouncing back to the wafer.

In an example shown in FIG. 35B, while the polishing liquid is supplied onto the rotating wafer W, the polishing head 30 is in a position away from the wafer W such that the polishing liquid, once spun off from the wafer W, does not bounce back to the wafer W. A velocity of the polishing liquid released from the rotating wafer W depends on the rotational speed of the wafer W. Therefore, the operation controller 69 can determine the position of the polishing head 30 (i.e., the distance from the wafer W) from the rotational speed of the wafer W. More specifically, a relationship between the rotational speed of the wafer W and the distance of the polishing head 30 from the wafer W can be expressed by a mathematical equation, and the operation controller 69 calculates the distance of the polishing head 30 from the wafer W using the mathematical equation. The specific positions of the polishing head 30 (the distances from the wafer W) at which the polishing liquid does not bounce back to the wafer W can be found by experiments and/or calculations.

Figure 36A:
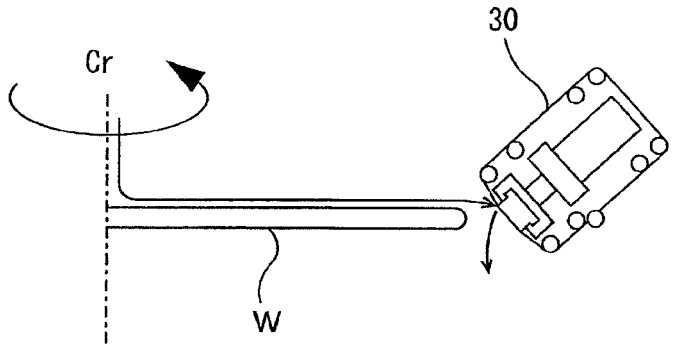
FIGS. 36A through 36C are views in which the polishing head is inclined so as to prevent the polishing liquid from bouncing back to the wafer.
Figure 36B:
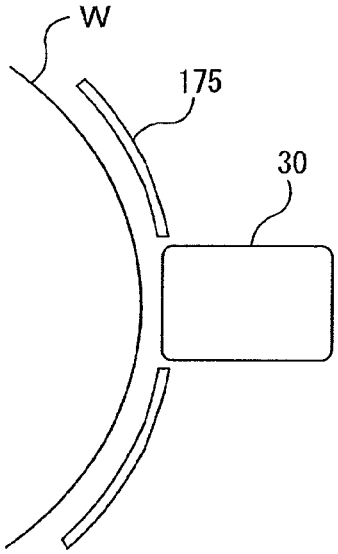
Figure 36C:
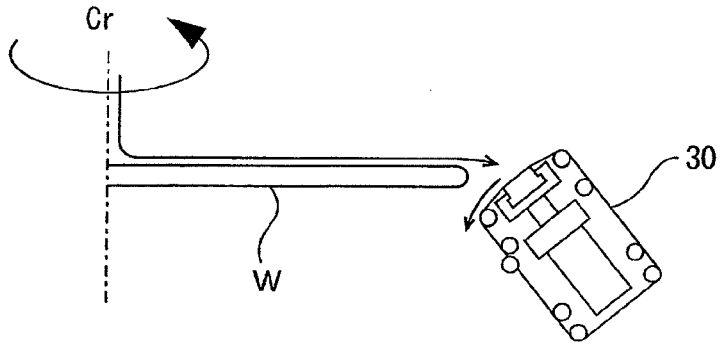

Instead of the distance of the polishing head 30, it is possible to adjust the angle of inclination of the polishing head 30 so as to prevent the polishing liquid from bouncing back. Specifically, as shown in FIG. 36A, the polishing head 30 is inclined such that the front thereof faces downwardly. By inclining the polishing head 30 in this manner, the polishing liquid, impinging upon the polishing head 30, flows downwardly. In this case also, the operation controller 69 can determine the angle of inclination of the polishing head 30 from the rotational speed of the wafer W. As shown in FIG. 36B, it is preferable that the front of the polishing head 30 lie in substantially the same position (i.e., at the same radial distance from the wafer W) as an inner circumferential surface of the shroud cover 175. The purpose of this arrangement is to minimize a step (i.e., a difference in radial position) between the shroud cover 175 and the polishing head 30 so as to prevent the polishing liquid from bouncing back. Further, as shown in FIG. 36C, the polishing head 30 may be inclined such that the front thereof faces upwardly. In this case also, it is possible to cause the polishing liquid, impinging upon the polishing head 30, to flow downwardly.

When polishing the periphery of the wafer W, the polishing head 30 is moved toward the wafer W until the polishing tape 23 is brought into contact with the periphery of the wafer W by the polishing head 30, while the angle of inclination of the polishing head 30 shown in FIG. 36A or FIG. 36C is maintained as it is. With such operations, the polishing head 30 can be moved toward the wafer W while preventing the polishing liquid from bouncing back to the wafer W. This embodiment is not limited to the case of supplying the polishing liquid, but can also be applied to the above-described cases of supplying the cooling liquid and the cleaning water. Further, it is possible to apply a combination of the position and the angle of inclination of the polishing head 30 for preventing the polishing liquid from bouncing back.

Figure 37:
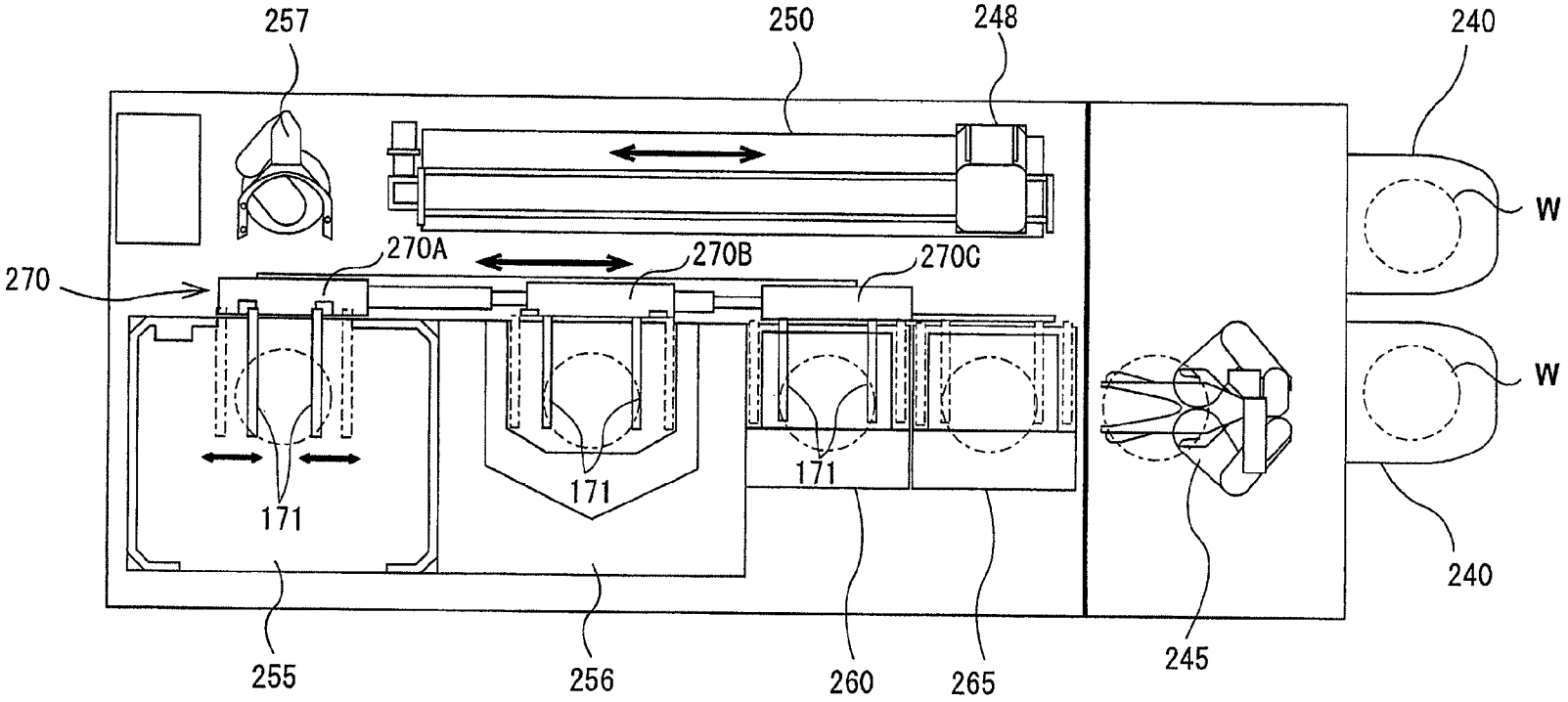
FIG. 37 is a plan view showing a substrate processing apparatus incorporating the polishing apparatus according to the first embodiment and the polishing apparatus according to the second embodiment.

FIG. 37 is a plan view showing a substrate processing apparatus incorporating the polishing apparatus according to the first embodiment and the polishing apparatus according to the second embodiment. This substrate processing apparatus includes two loading ports 240 configured to put the wafer W into the substrate processing apparatus, a first transfer robot 245 configured to remove the wafer W from wafer cassettes (not shown in the drawing) on the loading ports 240, a notch aligner 248 configured to detect the position of the notch portion of the wafer W and rotate the wafer W such that the notch portion is in a predetermined position, a notch-aligner moving mechanism 250 configured to move the notch aligner 248 linearly, a notch polishing unit (the polishing apparatus according to the second embodiment) 255 configured to polish the notch portion, a second transfer robot 257 configured to transfer the wafer W from the notch aligner 248 to the notch polishing unit 255, a bevel polishing unit (the polishing apparatus according to the first embodiment) 256 configured to polish the bevel portion of the wafer W, a cleaning unit 260 configured to clean the polished wafer W, a drying unit 265 configured to dry the cleaned wafer W, and a transfer mechanism 270 configured to transfer the wafer W from the notch polishing unit 255 to the bevel polishing unit 256, the cleaning unit 260, the drying unit 265 successively in this order. The notch aligner 248 is also used as a temporary base on which the wafer W is temporarily placed.

The notch polishing unit 255, the bevel polishing unit 256, the cleaning unit 260, and the drying unit 265 (hereinafter, these units will be referred to as processing units) are arranged on a linear line, and the transfer mechanism 270 is arranged along an arrangement direction of these processing units. The transfer mechanism 270 has hand units 270A, 270B, and 270C each having a pair of hands 171 for holding the wafer W. These hand units 270A, 270B, and 270C are operable to transfer the wafer W between the neighboring processing units. More specifically, the hand unit 270A is to remove the wafer W from the notch polishing unit 255 and transfer it to the bevel polishing unit 256, the hand unit 270B is to remove the wafer W from the bevel polishing unit 256 and transfer it to the cleaning unit 260, and the hand unit 270C is to remove the wafer W from the cleaning unit 260 and transfer it to the drying unit 265. These hand units 270A, 270B, and 270C are movable linearly along the arrangement direction of the processing units.

The hand units 270A, 270B, and 270C are operable to remove the wafers W simultaneously, move the wafers W linearly together with each other, and transfer the wafers W simultaneously to the downstream processing units. As can be seen from FIG. 37, the three hand units 270A, 270B, and 270C move their predetermined distances that vary depending on a distance (pitch) between two centers of wafers W in the transfer positions in the adjacent two processing units. The three hand units 270A, 270B, and 270C are configured to move the different distances independently of each other, so that the hand units 270A, 270B, and 270C can access the respective transfer positions. Therefore, a degree of freedom in combination of the processing units is increased. The number of hand units is not limited to three, and can be selected properly depending on the number of processing units.

Next, flow of the wafer W will be described. When the wafer cassette, which is capable of storing plural wafers (e.g., twenty-five wafers) W therein, is mounted on the loading port 240, this wafer cassette is automatically opened so that the wafers W can be loaded into the substrate processing apparatus. After the wafer cassette is opened, the first transfer robot 245 removes a wafer W from the wafer cassette, and transfers the wafer W onto the notch aligner 248. The notch aligner 248 is moved together with the wafer W by the notch-aligner moving mechanism 250 to a position near the second transfer robot 257. During this movement, the notch aligner 248 detects the position of the notch portion of the wafer W and rotates the wafer W such that the notch portion is in a predetermined position.

Then, the second transfer robot 257 receives the wafer W from the notch aligner 248, and transfers the wafer W into the notch polishing unit 255. Since the positioning of the notch portion has been already performed by the notch aligner 248, the wafer W is transferred into the notch polishing unit 255, with the notch portion lying in the predetermined position. Instead of the notch aligner 248, the notch polishing unit 255 may perform the positioning of the wafer W as described above.

The wafer W is processed in the notch polishing unit 255, and is then transferred to the bevel polishing unit 256, the cleaning unit 260, and the drying unit 265 successively in this order by the hand units 270A, 270B, and 270C, so that the wafer W is processed in these processing units. After processed in the drying unit 265, the wafer is transferred by the first transfer robot 245 into the wafer cassette on the loading port 240.

In this substrate processing apparatus shown in FIG. 37, the polishing apparatus according to the second embodiment is used as the notch polishing unit 255. Alternatively, the polishing apparatus according to the third embodiment may be used as the notch polishing unit 255.

Figure 38:
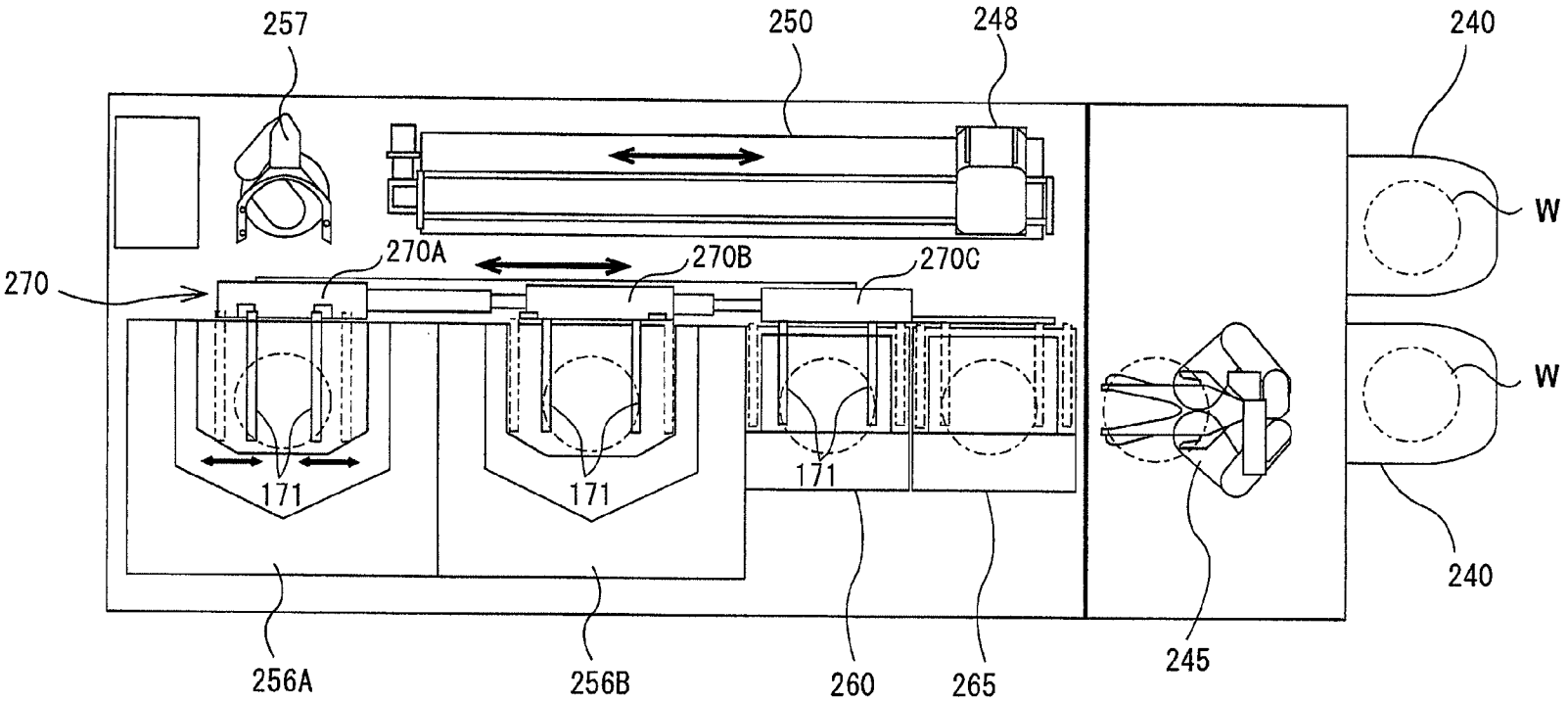
FIG. 38 is a plan view showing a modification of the substrate processing apparatus having a bevel polishing unit instead of a notch polishing unit shown in FIG. 37.

FIG. 38 is a plan view showing a modification of the substrate processing apparatus having a bevel polishing unit instead of the notch polishing unit shown in FIG. 37. This bevel polishing unit has the same structure as that of the first embodiment.

The substrate processing apparatus of this example is configured to polish a wafer using four polishing heads with polishing tapes each having rough abrasive grains in an upstream bevel polishing unit 256A, and polish the wafer using four polishing heads with polishing tapes each having fine abrasive grains in a downstream bevel polishing unit 256B. According to this substrate processing apparatus, a processing capability of the apparatus (i.e., the number of wafers W that can be processed per unit time) can be increased. The combination of the processing units in this example can be applied to a process that does require notch polishing.

It is also possible to polish a wafer using the polishing tapes each having abrasive grains fixed on the tape base in the upstream bevel polishing unit 256A, and polish the wafer using tape-like polishing cloths while supplying a slurry (i.e., free abrasive grains) to the wafer in the downstream bevel polishing unit 256B. Further, it is also possible to polish a wafer by the abrasive grains of the polishing tape, polish the wafer by the slurry, and clean the wafer by a tape-like cleaning cloth, attached to one of the polishing heads, successively in the downstream bevel polishing unit 256B.

The transfer mechanism 270 is configured to transfer and receive two wafers W simultaneously in the upstream bevel polishing unit 256A and the downstream bevel polishing unit 256B. Therefore, the wafers W can be transferred quickly. In this case also, as described above, the polishing heads can be cleaned when the wafer W lie in the clean space above the horizontal plane K. Therefore, it is not necessary to remove the wafer W from the bevel polishing unit in order to clean the polishing heads, and it is therefore possible to clean the polishing heads each time polishing of the wafer W is performed.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. A polishing method comprising:

rotating a substrate by a rotary holding mechanism;

polishing a first region in a periphery of the substrate by pressing a polishing tape against the first region;

polishing a second region in the periphery of the substrate by pressing the polishing tape against the second region;

during said polishing of the second region, cleaning the first region by pressing a cleaning cloth against the first region; and after said polishing of the second region, cleaning the second region by pressing the cleaning cloth against the second region.

2. The polishing method according to claim 1, wherein the polishing tape is pressed against the first region and the second region at different angles.

3. The polishing method according to claim 1, wherein:

the first region is a lower slope of the periphery of the substrate; and the second region is an edge surface of the periphery of the substrate.

4. A polishing method comprising:

rotating a substrate by a rotary holding mechanism;

polishing a periphery of the substrate by pressing a polishing tape against the periphery of the substrate; and during said polishing, supplying a cooling liquid having a temperature of at most 10° C. to both the periphery of the substrate and the polishing tape simultaneously, thereby removing a frictional heat from a contact portion between the substrate and the polishing tape.

5. The polishing method according to claim 4, wherein the polishing tape comprises abrasive grains and a resin.

6. A polishing method comprising:

rotating a substrate by a rotary holding mechanism;

supplying a liquid onto the rotating substrate;

during said supplying of the liquid onto the rotating substrate, pressing a polishing tape by a first polishing head against a periphery of the substrate so as to polish the periphery; and during said supplying of the liquid onto the rotating substrate, keeping a second polishing head, that does not perform polishing, away from the substrate such that the liquid does not bounce back to the substrate.

7. The polishing method according to claim 6, wherein a distance between the substrate and the second polishing head is determined based on a rotational speed of the substrate.

8. A polishing method comprising:

rotating a substrate by a rotary holding mechanism;

supplying a liquid onto the rotating substrate;

during said supplying of the liquid onto the rotating substrate, pressing a polishing tape by a first polishing head against a periphery of the substrate so as to polish the periphery; and during said supplying of the liquid onto the rotating substrate, keeping a second polishing head, that does not perform polishing, inclined at such an angle that the liquid does not bounce back to the substrate.

9. The polishing method according to claim 8, wherein the angle of the second polishing head is determined based on a rotational speed of the substrate.

10. The polishing method according to claim 8, further comprising:

moving the second polishing head toward the rotating substrate while keeping the angle thereof; and causing the second polishing head to press a polishing tape against the periphery of the substrate.

* * * * *